US011378286B2

(12) United States Patent
Morita et al.

(10) Patent No.: US 11,378,286 B2
(45) Date of Patent: Jul. 5, 2022

(54) OUTDOOR UNIT

(71) Applicant: Mitsubishi Electric Corporation, Tokyo (JP)

(72) Inventors: Atsushi Morita, Tokyo (JP); Yusuke Tashiro, Tokyo (JP); Komei Nakajima, Tokyo (JP); Hiroaki Makino, Tokyo (JP); Yusuke Tsuboi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 252 days.

(21) Appl. No.: 16/499,469

(22) PCT Filed: Jun. 12, 2017

(86) PCT No.: PCT/JP2017/021642
§ 371 (c)(1),
(2) Date: Sep. 30, 2019

(87) PCT Pub. No.: WO2018/229829
PCT Pub. Date: Dec. 20, 2018

(65) Prior Publication Data

US 2020/0096208 A1 Mar. 26, 2020

(51) Int. Cl.
*F24F 1/24* (2011.01)
*F24F 1/14* (2011.01)
*F24F 13/20* (2006.01)

(52) U.S. Cl.
CPC ..... *F24F 1/24* (2013.01); *F24F 1/14* (2013.01); *F24F 13/20* (2013.01); *F24F 2013/202* (2013.01)

(58) Field of Classification Search
CPC .. F24F 1/02; F24F 1/0325; F24F 13/20; F24F 1/14; F24F 2013/207; F24F 1/24
See application file for complete search history.

(56) References Cited

U.S. PATENT DOCUMENTS

2015/0319885 A1* 11/2015 Uehara ..... F24F 1/18 361/700
2017/0205086 A1* 7/2017 Yanase ..... F24F 1/24

FOREIGN PATENT DOCUMENTS

CN 103968469 A 8/2014
CN 105180307 A * 12/2015
(Continued)

OTHER PUBLICATIONS

CN-105180307-A Translation (Year: 2015).*
(Continued)

*Primary Examiner* — Schyler S Sanks
(74) *Attorney, Agent, or Firm* — Posz Law Group, PLC

(57) ABSTRACT

An outdoor unit includes a casing including an air passage, an outdoor fan disposed in the air passage, a compressor disposed in the casing, an outdoor heat exchanger disposed in the casing and including fins and a heat transfer tube connected to the fins, a control board disposed in the casing and including a control unit that controls the compressor, and a heat sink disposed in the air passage in the casing and being in contact with the control board. The heat transfer tube of the outdoor heat exchanger includes a first region in which gas refrigerant or two-phase gas-liquid refrigerant flows when the outdoor heat exchanger is used as a condenser and a second region that is located downstream of the first region in a refrigerant flow direction and in which single-phase liquid refrigerant flows.

16 Claims, 19 Drawing Sheets

(56) References Cited

FOREIGN PATENT DOCUMENTS

| | | | | |
|---|---|---|---|---|
| EP | 3 163 186 | A1 | 5/2017 | |
| JP | 2007-271212 | A | 10/2007 | |
| JP | 2008-275201 | A | 11/2008 | |
| JP | 2012-127591 | A | 7/2012 | |
| KR | 2000-0021484 | A | 4/2000 | |
| WO | 2010/087481 | A1 | 8/2010 | |
| WO | WO-2015151544 | A1 * | 10/2015 | ..... F24F 1/24 |

OTHER PUBLICATIONS

Extended European Search Report dated May 18, 2020 issued in corresponding European patent application No. 17913226.1.
Office Action dated Oct. 23, 2020 issued in corresponding CN patent application No. 201780091546.4.(and English Translation).
Indian Examination Report dated Mar. 19, 2021, issued in corresponding Indian Patent Application No. 201947047513 (and English Machine Translation).

* cited by examiner

OUTDOOR UNIT

CROSS REFERENCE TO RELATED APPLICATION

This application is a U.S. national stage application of International Application No. PCT/JP2017/021642, filed on Jun. 12, 2017, the contents of which are incorporated herein by reference.

TECHNICAL FIELD

The present invention relates to outdoor units, and in particular, relates to an outdoor unit including a heat sink that promotes dissipation of heat from a controller.

BACKGROUND

An outdoor unit of a refrigeration cycle apparatus includes a control board that controls, for example, a compressor. On the control board, for example, an inverter is mounted. The inverter includes a semiconductor device for driving an electric motor of a compressor. The inverter generates heat when the inverter drives the electric motor of the compressor. Heat generation of the inverter reduces the life of, for example, the semiconductor device included in the inverter. Heat generation of the inverter further causes another device mounted on the control board to generate heat, thus reducing the life of the device. For this reason, some outdoor units of refrigeration cycle apparatuses include a heat sink to promote dissipation of heat from a control board. However, for example, in a case where such a refrigeration cycle apparatus is operated in the summer, the temperature of the control board is highly likely to rise beyond an allowable temperature range even though the heat sink dissipates heat from the control board.

A developed refrigeration cycle apparatus includes a heat sink that is cooled by using refrigerant reduced in pressure by an expansion valve (refer to Patent Literature 1, for example). The refrigeration cycle apparatus disclosed in Patent Literature 1 includes a cooling pipe that helps heat dissipation of the heat sink. The cooling pipe is disposed downstream of the expansion valve in a refrigerant flow direction and is located upstream of an evaporator in the refrigerant flow direction. The heat sink of the refrigeration cycle apparatus disclosed in Patent Literature 1 receives cooling energy through the cooling pipe from the refrigerant cooled by the expansion valve and leaving the expansion valve.

PATENT LITERATURE

Patent Literature 1: Japanese Unexamined Patent Application Publication No. 2012-127591

The cooling pipe included in the refrigeration cycle apparatus disclosed in Patent Literature 1 can help cool the heat sink. However, the cooling pipe included in the refrigeration cycle apparatus disclosed in Patent Literature 1 causes part of the refrigerant leaving the expansion valve to evaporate in the cooling pipe. Evaporation of the refrigerant cools the evaporator. Evaporation of part of the refrigerant leaving the expansion valve in the cooling pipe results in a reduction in amount of evaporation of the refrigerant in the evaporator. In other words, the evaporation of part of the refrigerant leaving the expansion valve in the cooling pipe results in a reduction in difference between the enthalpy of the refrigerant leaving the evaporator and the enthalpy of the refrigerant entering the evaporator. Disadvantageously, the cooling pipe included in the refrigeration cycle apparatus disclosed in Patent Literature 1 causes a reduction in cooling capacity.

SUMMARY

The present invention has been made to solve the above-described problem, and aims to provide an outdoor unit that facilitates heat dissipation of a heat sink while reducing or eliminating a reduction in cooling capacity.

An outdoor unit according to an embodiment of the present invention includes a casing including an air passage, an outdoor fan disposed in the air passage, a compressor disposed in the casing, an outdoor heat exchanger disposed in the casing and including fins and a heat transfer tube connected to the fins, a control board disposed in the casing and including a control unit that controls the compressor, and a heat sink disposed in the air passage in the casing and being in contact with the control board. The heat transfer tube of the outdoor heat exchanger includes a first region in which gas refrigerant or two-phase gas-liquid refrigerant flows when the outdoor heat exchanger is used as a condenser and a second region that is located downstream of the first region in a refrigerant flow direction and in which single-phase liquid refrigerant flows. The heat sink is disposed downstream of the outdoor heat exchanger in an air flow direction in the air passage. The heat sink is located at a first distance from the first region and is located at a second distance from the second region. The second distance is shorter than the first distance.

The outdoor unit according to an embodiment of the present invention includes no component like the cooling pipe described in Patent Literature 1. Such a configuration can reduce or eliminate a reduction in amount of evaporation of the refrigerant in the outdoor heat exchanger. Thus, the outdoor unit according to an embodiment of the present invention can reduce or eliminate a reduction in cooling capacity. In the outdoor unit according to an embodiment of the present invention, the second distance between the heat sink and the second region is shorter than the first distance between the heat sink and the first region. This arrangement reduces or eliminates a rise in temperature of air to be supplied to the heat sink. Thus, the outdoor unit according to an embodiment of the present invention facilitates heat dissipation of the heat sink. The outdoor unit according to an embodiment of the present invention therefore facilitates heat dissipation of the heat sink while reducing or eliminating a reduction in cooling capacity.

DETAILED DESCRIPTION

Figure 1:
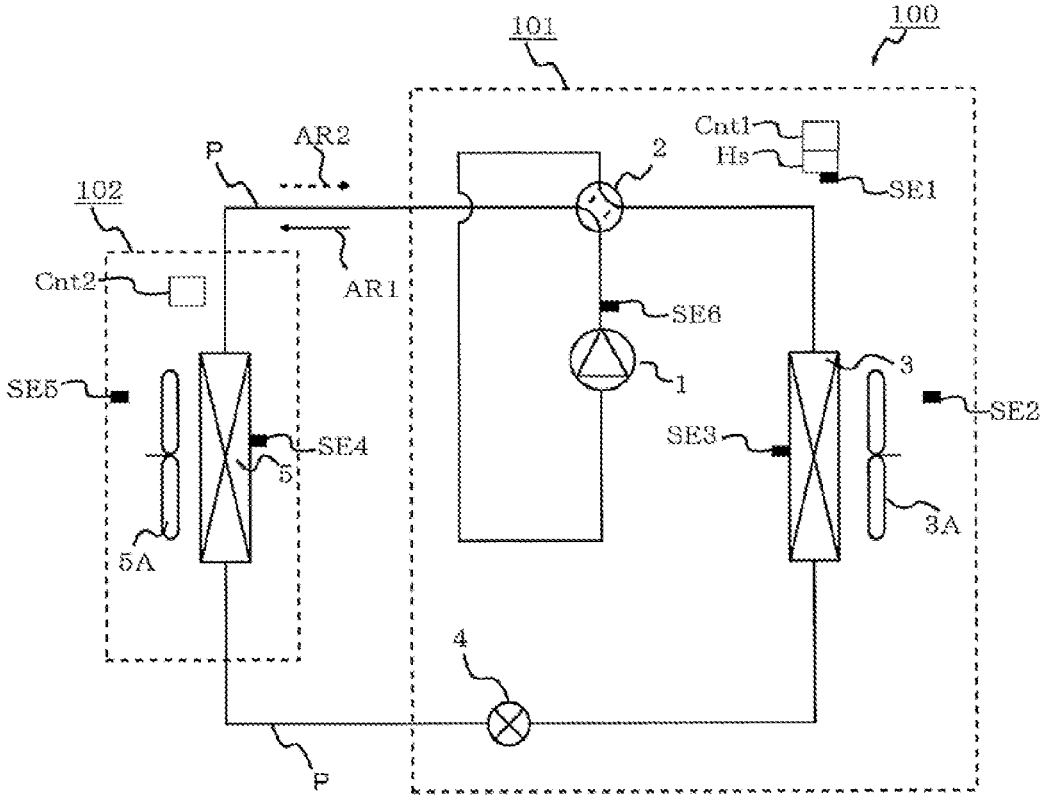
FIG. 1 is a diagram illustrating, for example, a refrigerant circuit configuration of a refrigeration cycle apparatus 100 including an outdoor unit 101 according to Embodiment 1.

Outdoor units 101 according to embodiments of the present invention will be described with reference to, for example, the drawings. Note that components designated by the same reference signs in the following drawings including FIG. 1 are the same components or equivalents. This note applies to the entire description of the embodiments described below.

Embodiment 1

Figure 2:
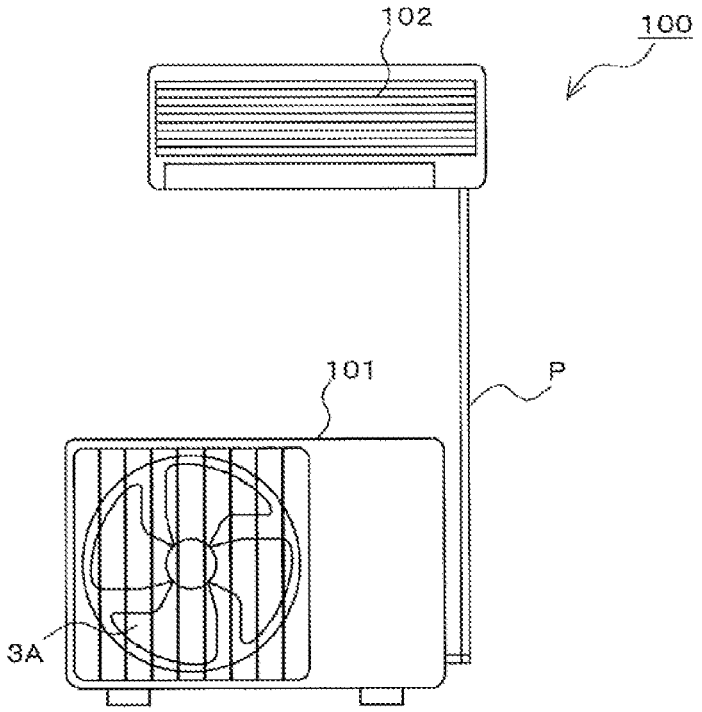
FIG. 2 is a schematic diagram illustrating, for example, the outdoor unit 101 according to Embodiment 1.

FIG. 1 is a diagram illustrating, for example, a refrigerant circuit configuration of a refrigeration cycle apparatus 100 including an outdoor unit 101 according to Embodiment 1. In FIG. 1, an arrow AR1 represents a refrigerant flow direction in a heating operation of the refrigeration cycle apparatus 100 and an arrow AR2 represents the refrigerant flow direction in a cooling operation of the refrigeration cycle apparatus 100. FIG. 2 is a schematic diagram illustrating, for example, the outdoor unit 101 according to Embodiment 1. Embodiment 1 will be described as an example that the refrigeration cycle apparatus 100 is an air-conditioning apparatus.

The refrigeration cycle apparatus 100 includes the outdoor unit 101 and an indoor unit 102. The outdoor unit 101 and the indoor unit 102 are connected by refrigerant pipes P. The outdoor unit 101 includes a compressor 1 that compresses refrigerant, a four-way valve 2 that switches passages, an expansion device 4 that reduces the pressure of the refrigerant, an outdoor heat exchanger 3 that exchanges heat between the refrigerant and air, and an outdoor fan 3A that supplies the air to the outdoor heat exchanger 3. The indoor unit 102 includes an indoor heat exchanger 5 that exchanges heat between the refrigerant and air and an indoor fan 5A that supplies the air to the indoor heat exchanger 5.

The refrigeration cycle apparatus 100 includes a control board Cnt1 disposed in the outdoor unit 101 and a control board Cnt2 disposed in the indoor unit 102. The control board Cnt1 and the control board Cnt2 are connected by a communication line (not illustrated) to establish communication. The refrigeration cycle apparatus 100 includes a heat sink Hs attached to the control board Cnt1 and a first sensor SE1 mounted on the heat sink Hs. The first sensor SE1 measures the temperature of the heat sink Hs. The refrigeration cycle apparatus 100 further includes a second sensor SE2 to measure an outdoor air temperature, a third sensor SE3 to measure the temperature of the outdoor heat exchanger 3, and a fourth sensor SE4 to measure the temperature of the indoor heat exchanger 5. In addition, the refrigeration cycle apparatus 100 includes a fifth sensor SE5 to measure an indoor air temperature and a sixth sensor SE6 to measure the temperature of the refrigerant discharged from the compressor 1.

Figure 3:
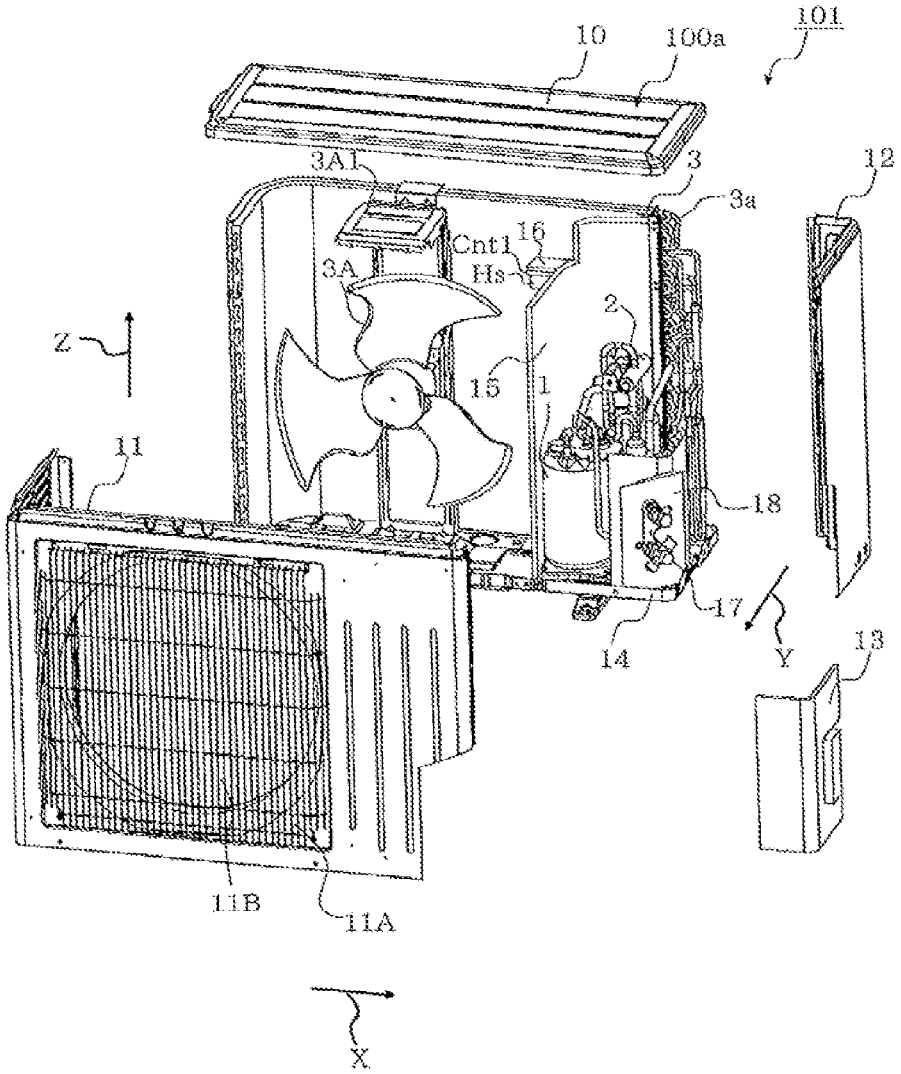
FIG. 3 is an exploded perspective view of the outdoor unit 101 according to Embodiment 1.

FIG. 3 is an exploded perspective view of the outdoor unit 101 according to Embodiment 1.

Figure 4:
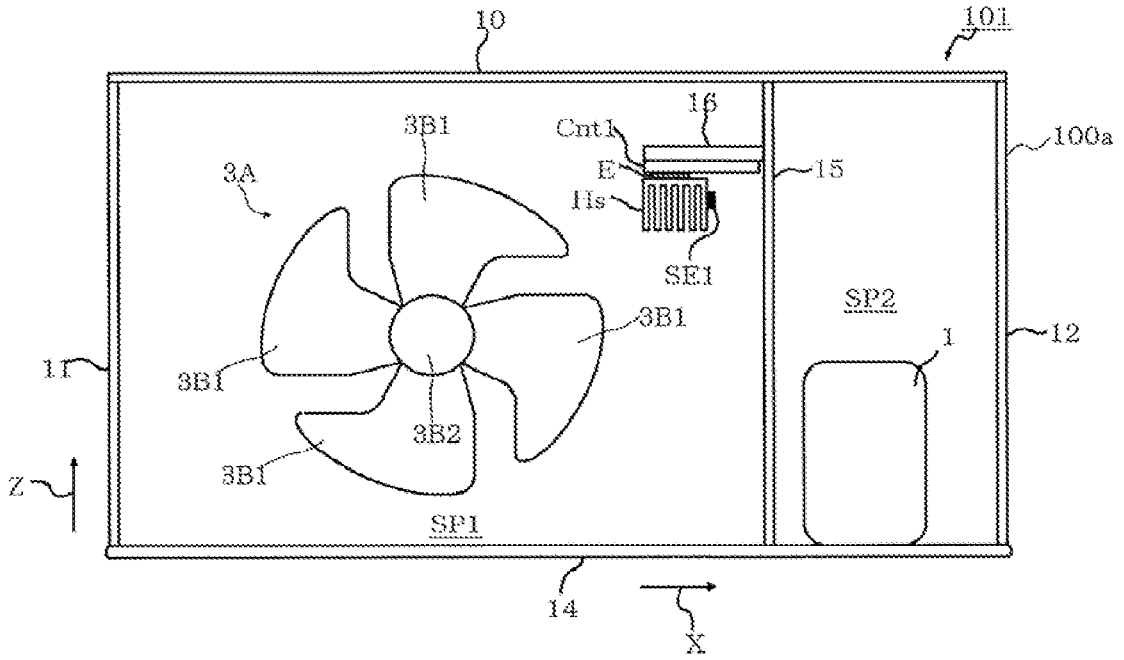
FIG. 4 is a schematic diagram of the outdoor unit 101 according to Embodiment 1 as viewed from the front of an air outlet 11B of the outdoor unit 101.

FIG. 4 is a schematic diagram of the outdoor unit 101 according to Embodiment 1 as viewed from the front of an air outlet 11B of the outdoor unit 101.

Figure 5:
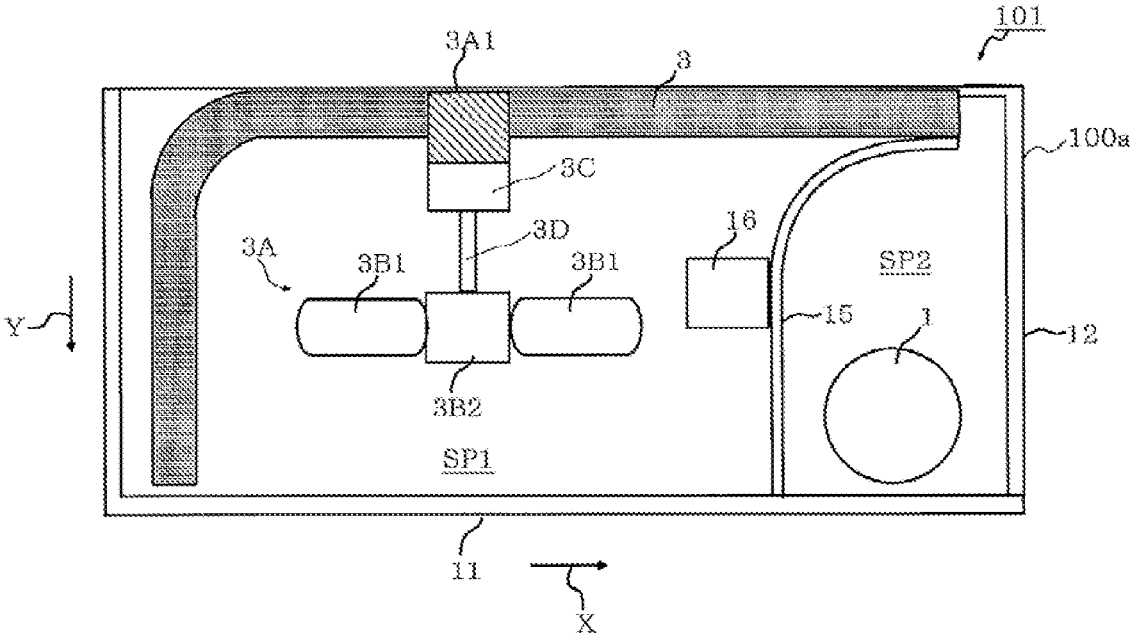
FIG. 5 is a schematic diagram of the outdoor unit 101 according to Embodiment 1 as viewed from above the outdoor unit 101.

FIG. 5 is a schematic diagram of the outdoor unit 101 according to Embodiment 1 as viewed from above the outdoor unit 101. As illustrated in FIGS. 3 to 5, the term "Z direction" as used herein refers to a height direction of the outdoor unit 101, the term "Y direction" refers to an air flow direction in which the air passes through the outdoor unit 101, and the term "X direction" refers to a direction orthogonal to the Z direction and the Y direction. The X direction and the Y direction are parallel to a horizontal plane.

The outdoor unit 101 includes a casing 100*a* including an air passage SP1 and a compressor chamber SP2. The casing 100*a* contains the compressor 1, the outdoor heat exchanger 3, and the outdoor fan 3A. The casing 100*a* includes a first panel 10 disposed above the outdoor heat exchanger 3 and the outdoor fan 3A, a second panel 11 having the air outlet 11B, and a third panel 12 separating the compressor chamber SP2 from a space outside the outdoor unit 101. The casing 100*a* further includes a partition 15 separating the air passage SP1 from the compressor chamber SP2. In addition, the casing 100*a* includes a bottom plate 14 supporting, for example, the compressor 1 and the outdoor heat exchanger 3. Additionally, the casing 100*a* includes a cover 13 to cover valves 17. A fan grille 11A is attached to the second panel 11.

The outdoor unit 101 includes the valves 17 and a valve mounting plate 18 on which the valves 17 are mounted. The valves 17 are connected to ends of the refrigerant pipes P (refer to FIGS. 1 and 2).

The outdoor unit 101 includes a motor support 3A1 supporting the outdoor fan 3A. The motor support 3A1 is attached to the outdoor heat exchanger 3. The outdoor fan 3A includes a plurality of blades 3B1, a boss 3B2, an electric motor 3C, and a shaft 3D. The blades 3B1 radially extend from the boss 3B2. A first end of the shaft 3D is fixed to the boss 3B2 and a second end of the shaft 3D is fixed to the electric motor 3C. The electric motor 3C is attached to the motor support 3A1.

The partition 15 separates the air passage SP1 containing, for example, the outdoor heat exchanger 3 and the outdoor fan 3A, from the compressor chamber SP2 containing, for example, the compressor 1. A mounting plate 16 is fixed to the partition 15. The control board Cnt1 is attached to the mounting plate 16. The mounting plate 16, the heat sink Hs, and the control board Cnt1 are arranged in the air passage SP1. The heat sink Hs is in contact with the control board Cnt1. The heat sink Hs, which is in contact with the control board Cnt1, promotes dissipation of heat from the control board Cnt1. The heat sink Hs is disposed downstream in the air flow direction in the air passage SP1. This arrangement causes the heat sink Hs to be supplied with the air while the outdoor fan 3A is operating, thus facilitating heat dissipation of the heat sink Hs. The air to be supplied to the heat sink Hs passes through the outdoor heat exchanger 3. While the refrigeration cycle apparatus 100 is performing the cooling operation, the outdoor heat exchanger 3 is used as a condenser. Consequently, the air passing through the outdoor heat exchanger 3 increases in temperature in the cooling operation of the refrigeration cycle apparatus 100. In the refrigeration cycle apparatus 100, the air with a small increase in temperature is supplied to the heat sink Hs to further facilitate heat dissipation of the heat sink Hs.

Figure 6:
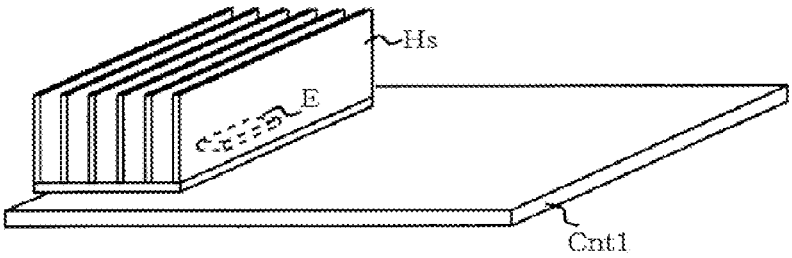
FIG. 6 is a perspective view of a heat sink Hs and a control board Cnt1 included in the outdoor unit 101 according to Embodiment 1.

FIG. 6 is a perspective view of the heat sink Hs and the control board Cnt1 included in the outdoor unit 101 according to Embodiment 1.

The control board Cnt1 includes an inverter E including a semiconductor device. Examples of the semiconductor device of the inverter E include a power semiconductor device. The inverter E is configured to drive an electric motor disposed at the compressor 1. The inverter E is electrically connected to a power supply circuit and a circuit including the electric motor of the compressor 1. Higher outdoor air temperature conditions result in proportionately higher thermal loads in rooms. For this reason, in a case where the refrigeration cycle apparatus 100 performs the cooling operation under high outdoor air temperature conditions, the control board Cnt1 typically sets a rotation frequency of the compressor 1 to a high value. Consequently, the indoor unit 102 enables the indoor air temperature to immediately approach a set temperature for an indoor space. Increasing the rotation frequency of the compressor 1 increases a current (primary current) in the power supply circuit accordingly. In the case where the refrigeration cycle apparatus 100 performs the cooling operation under high outdoor air temperature conditions, the amount of heat generated from the inverter E increases.

An increase in amount of heat generated from the inverter E causes an increase in temperature of the semiconductor device included in the inverter E, thus reducing the life of the inverter E. In addition, heat generation of the inverter E causes an increase in temperature of a device in proximity to the inverter E, thus reducing the life of the device. For this reason, the heat sink Hs is disposed at the inverter E. This arrangement promotes dissipation of heat from the inverter E. As the heat sink Hs is disposed in the air passage SP1, the heat sink Hs is supplied with the air, thus further facilitating heat dissipation of the heat sink Hs.

Figure 7:
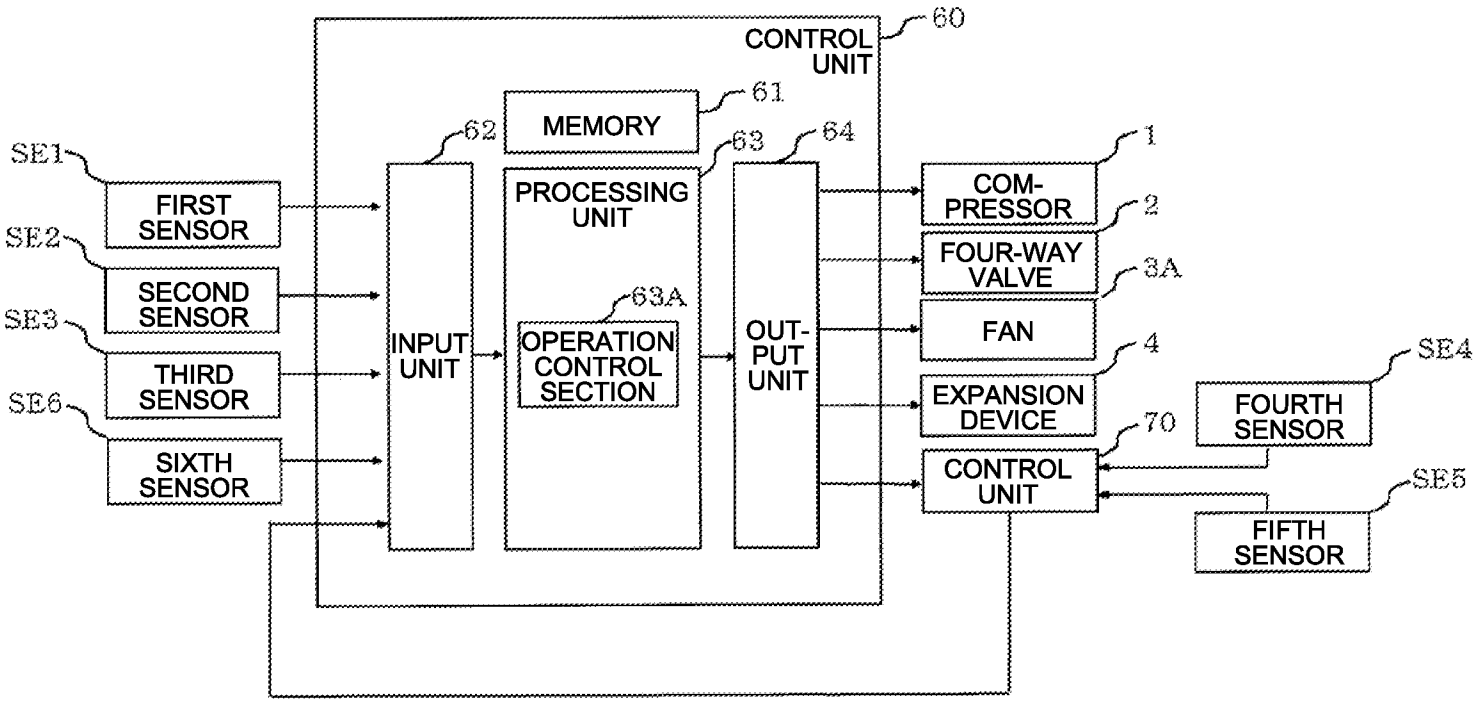
FIG. 7 is a functional block diagram of a control unit 60 included in the outdoor unit 101 according to Embodiment 1.

FIG. 7 is a functional block diagram of a control unit 60 included in the outdoor unit 101 according to Embodiment 1.

The control board Cnt1 includes the control unit 60. The control unit 60 includes a memory 61 to store various pieces of information, an input unit 62 to receive a sensor signal, a processing unit 63 to perform various operations, and an output unit 64 to output a control signal for controlling, for example, the compressor 1.

The input unit 62 receives sensor signals from the first sensor SE1, the second sensor SE2, the third sensor SE3, and the sixth sensor SE6. The input unit 62 further receives information output from a control unit 70 included in the control board Cnt2 disposed in the indoor unit 102. The processing unit 63 includes an operation control section 63A. The operation control section 63A generates a control signal for controlling, for example, the compressor 1, on the basis of the information acquired from the input unit 62. The output unit 64 outputs the control signal generated by the processing unit 63 to the compressor 1, for example.

Each functional part included in the control unit 60 is configured by dedicated hardware or a micro processing unit (MPU) that runs a program stored in the memory 61. In a case where the control unit 60 is dedicated hardware, the control unit 60 corresponds to a single circuit, a composite circuit, an application specific integrated circuit (ASIC), a field-programmable gate array (FPGA), or a combination of these circuits. The functional parts that the control unit 60 implements may be implemented by individual hardware components or may be implemented by a single hardware component. In a case where the control unit 60 is an MPU, the functions that the control unit 60 performs are achieved by software, firmware, or a combination of the software and the firmware. The software and the firmware are written as programs and the programs are stored in the memory 61. The MPU reads the programs stored in the memory 61 and runs the programs, thus achieving the functions of the control unit 60. The memory 61 is, for example, a nonvolatile or volatile semiconductor memory, such as a random access memory (RAM), a read-only memory (ROM), a flash memory, an erasable programmable read-only memory (EPROM), and an electrically erasable programmable read-only memory (EEPROM).

Figure 8:
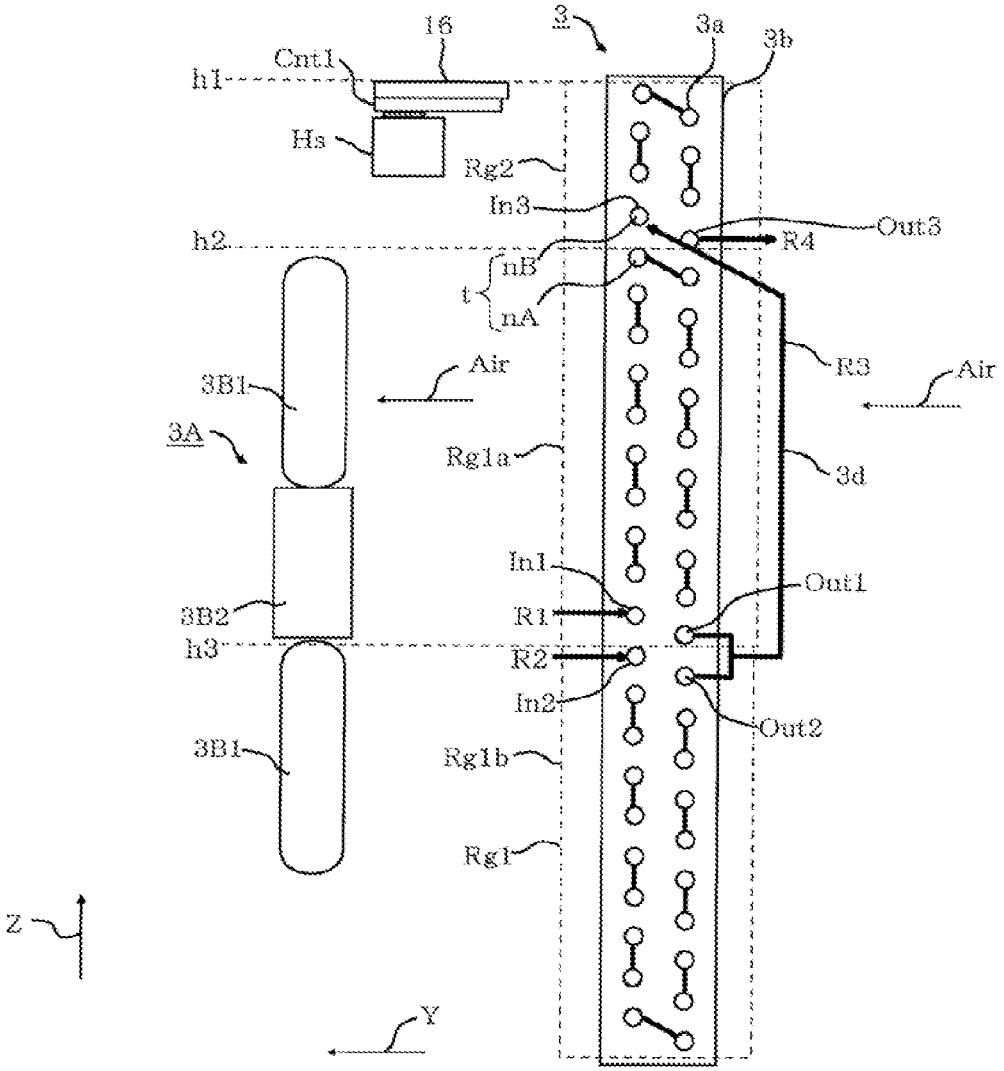
FIG. 8 is a diagram illustrating an arrangement of various components included in the outdoor unit 101 according to Embodiment 1.
Figure 9:
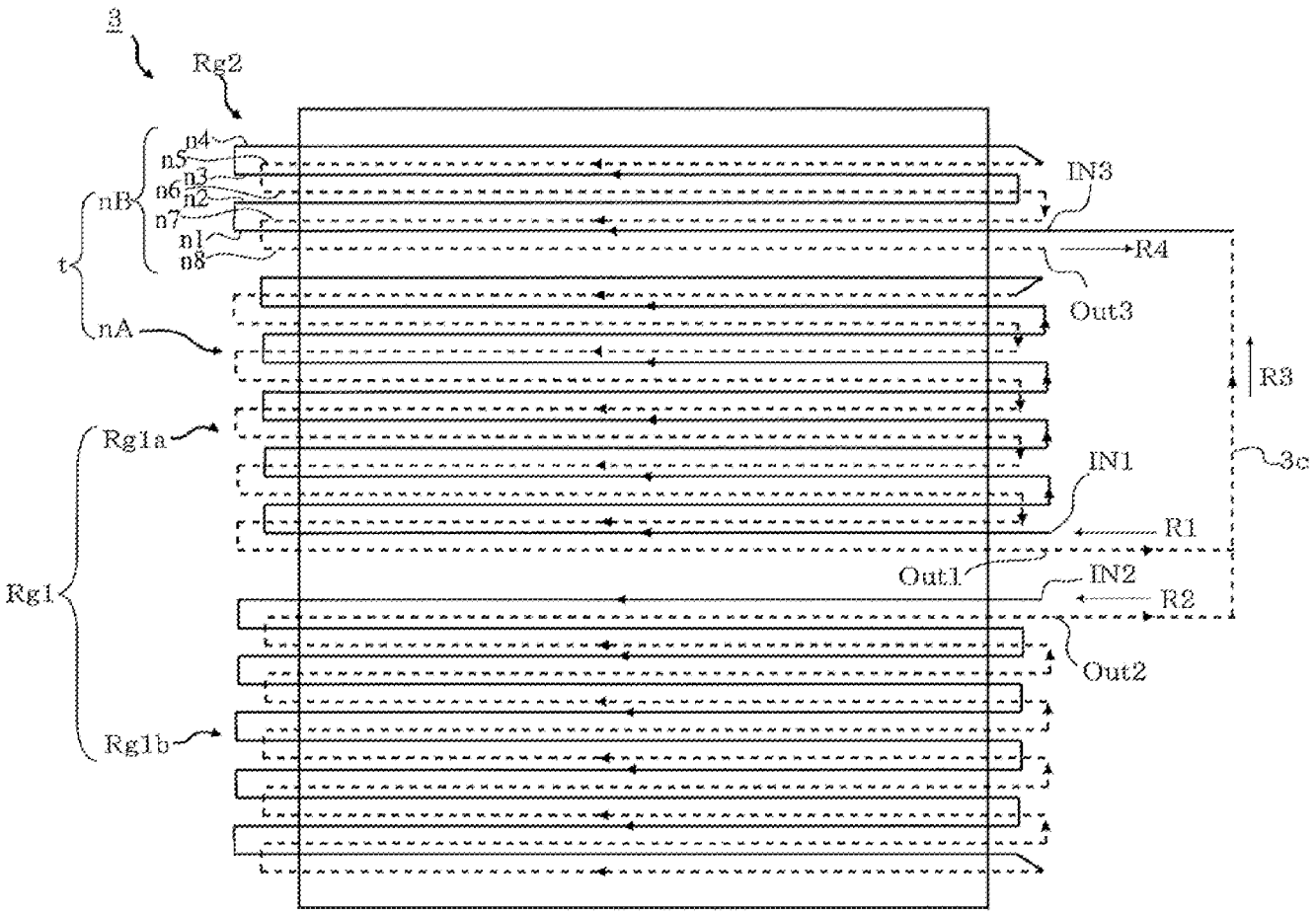
FIG. 9 is a schematic diagram illustrating the configuration of an outdoor heat exchanger 3 and flows of refrigerant through the outdoor heat exchanger 3.

FIG. 8 is a diagram illustrating an arrangement of various components included in the outdoor unit 101 according to Embodiment 1. FIG. 9 is a schematic diagram illustrating the configuration of the outdoor heat exchanger 3 and flows of the refrigerant through the outdoor heat exchanger 3. A distributor (not illustrated) is attached to the outdoor heat exchanger 3. The refrigerant leaving the distributor divides into two streams, refrigerant R1 and refrigerant R2. The refrigerant R1 enters an area Rg1*a* of a heat transfer tube 3*a* and the refrigerant R2 enters an area Rg1*b* of the heat transfer tube 3*a*.

The outdoor heat exchanger 3 includes the heat transfer tube 3*a* and a plurality of fins 3*b*. The heat transfer tube 3*a* includes a first region Rg1 in which gas refrigerant or two-phase gas-liquid refrigerant flows when the outdoor heat exchanger 3 is used as a condenser and a second region Rg2 that is located downstream of the first region Rg1 in the refrigerant flow direction and in which single-phase liquid refrigerant flows. In Embodiment 1, the first region Rg1 includes the area Rg1*a* and the area Rg1*b*. Both the area Rg1*a* and the area Rg1*b* are arranged upstream of the second region Rg2 in the refrigerant flow direction. The heat transfer tube 3*a* includes the area Rg1*a* and the area Rg1*b* arranged parallel to each other.

The area Rg1*a* of the first region Rg1 includes an inlet IN1 through which the refrigerant flows into the area and an outlet Out1 through which the refrigerant flows out of the area. The inlet IN1 is the most upstream portion of the area Rg1*a* and the outlet Out1 is the most downstream portion of the area Rg1*a*. The refrigerant R1 that flows through the outdoor heat exchanger 3 passes through the inlet IN1 and the outlet Out1 of the area Rg1*a* and enters a pipe 3*c*.

The area Rg1*b* of the first region Rg1 includes an inlet IN2 through which the refrigerant flows into the area and an outlet Out2 through which the refrigerant flows out of the area. The inlet IN2 is the most upstream portion of the area Rg1*b* and the outlet Out2 is the most downstream portion of the area Rg1*b*. The refrigerant R2 that flows through the outdoor heat exchanger 3 passes through the inlet IN2 and the outlet Out2 of the area Rg1*b* and enters the pipe 3*c*. In the pipe 3*c*, the refrigerant leaving the outlet Out1 of the area Rg1*a* joins the refrigerant leaving the outlet Out2 of the area Rg1*b*.

The second region Rg2 includes an inlet IN3 through which the refrigerant flows into the region and an outlet Out3 through which the refrigerant flows out of the region. The inlet IN3 is the most upstream portion of the second region Rg2 and the outlet Out3 is the most downstream portion of the second region Rg2. Refrigerant R3 that flows through the pipe 3*c* passes through the inlet IN3 and the outlet Out3 of the second region Rg2. In the case where the refrigeration cycle apparatus 100 is performing the cooling operation, refrigerant R4 leaving the outlet Out3 enters the expansion device 4 (refer to FIG. 1).

The air, represented by Air, to be supplied to the heat sink Hs passes through the outdoor heat exchanger 3. While the refrigeration cycle apparatus 100 is performing the cooling operation, the outdoor heat exchanger 3 is used as a condenser. Thus, the air Air increases in temperature by passing through the outdoor heat exchanger 3. Since the control board Cnt1 increases the rotation frequency of the compressor 1 as the outdoor air temperature becomes higher, a condensing temperature in the outdoor heat exchanger 3 rises with increasing outdoor air temperature. The higher the outdoor air temperature, the higher the temperature of the air Air to be supplied to the outdoor heat exchanger 3. A higher outdoor air temperature makes it more difficult to help heat dissipation of the heat sink Hs.

After the refrigerant enters the first region Rg1, the air Air receives the latent heat of condensation from the refrigerant and thus increases in temperature, causing the refrigerant to liquify. At this time, as the heat received from the refrigerant by the air Air is the latent heat, the temperature of the refrigerant remains unchanged. When the refrigerant leaving the first region Rg1 enters the second region Rg2, the refrigerant is single-phase liquid. After the refrigerant enters the second region Rg2, the air Air receives sensible heat from the refrigerant and thus increases in temperature, resulting in a reduction in temperature of the refrigerant. Consequently, the temperature of the refrigerant flowing in the second region Rg2 is lower than the temperature of the refrigerant flowing in the first region Rg1. The temperature of the air Air that has passed through the second region Rg2 is therefore lower than the temperature of the air Air that has passed through the first region Rg1. The heat sink Hs is located at a first distance from the first region Rg1 and is located at a second distance from the second region Rg2. The second distance is shorter than the first distance. This arrangement more effectively facilitates heat dissipation of the heat sink Hs than does an arrangement in which the second distance is longer than the first distance.

The second region Rg2 is located at a level higher than is the first region Rg1. In Embodiment 1, the second region Rg2 is located in the uppermost part of the outdoor heat exchanger 3. A level at which an upper end of the second region Rg2 is located is represented by a height coordinate h1. A level at which a lower end of the second region Rg2 and an upper end of the first region Rg1 are located is represented by a height coordinate h2. A level at which a lower end of the area Rg1*a* and an upper end of the area Rg1*b* are located is represented by a height coordinate h3. The heat sink Hs is located below the height coordinate h1 and above the height coordinate h2. The control board Cnt1 is also located below the height coordinate h1 and above the height coordinate h2. The height coordinate h1, the height coordinate h2, and the height coordinate h3 can be determined relative to, for example, the bottom plate 14, as a reference.

The heat transfer tube 3*a* of the outdoor heat exchanger 3 includes a plurality of horizontal parts t parallel to a horizontal direction. The horizontal parts t are tube portions parallel to the horizontal plane. In Embodiment 1, the total number of horizontal parts t of the outdoor heat exchanger 3 is 48. The horizontal parts t include first horizontal parts nA arranged in the first region Rg1 and second horizontal parts nB arranged in the second region Rg2. The first horizontal parts nA and the second horizontal parts nB are tube portions extending parallel to the horizontal plane. The number of horizontal parts in the area Rg1*a* of the first region Rg1 is 20. The number of horizontal parts in the area Rg1*b* of the first region Rg1 is 20. Thus, the total number of first horizontal parts nA is 40. The number of second horizontal parts nB is eight. The number of second horizontal parts nB is therefore less than the number of first horizontal parts nA. The reason why the number of second horizontal parts nB is eight will be described below. As illustrated in FIG. 9, the heat transfer tube 3*a* in the second region Rg2 includes horizontal part n1, horizontal part n2, horizontal part n3, horizontal part n4, horizontal part n5, horizontal part n6, horizontal part n7, and horizontal part n8. Each of the horizontal parts n1, n2, n3, n4, n5, n6, n7, and n8 is the second horizontal part nB. Thus, the number of second horizontal parts nB is eight. The first horizontal parts nA can be numbered in the same manner as for the second horizontal parts nB. The number of first horizontal parts nA is 40. When the refrigerant enters the inlet IN3 of the second region Rg2, the refrigerant flows into the horizontal part n1. After the refrigerant flows through the horizontal part n1, the refrigerant flows through the horizontal part n2, the horizontal part n3, the horizontal part n4, the horizontal part n5, the horizontal part n6, the horizontal part n7, and the horizontal part n8 in this order.

In the second region Rg2, the temperature of the single-phase liquid refrigerant is reduced to provide some degree of subcooling for the refrigerant. In the second region Rg2, it is only required that a predetermined degree of subcooling can be provided for the single-phase liquid refrigerant. In Embodiment 1, the number of second horizontal parts nB in the second region Rg2 is less than the number of first horizontal parts nA in the first region Rg1. This arrangement further ensures that the refrigerant liquifies in the first region Rg1. As a result, this arrangement further ensures that the single-phase liquid refrigerant is supplied from the first region Rg1 to the second region Rg2.

Figure 10:
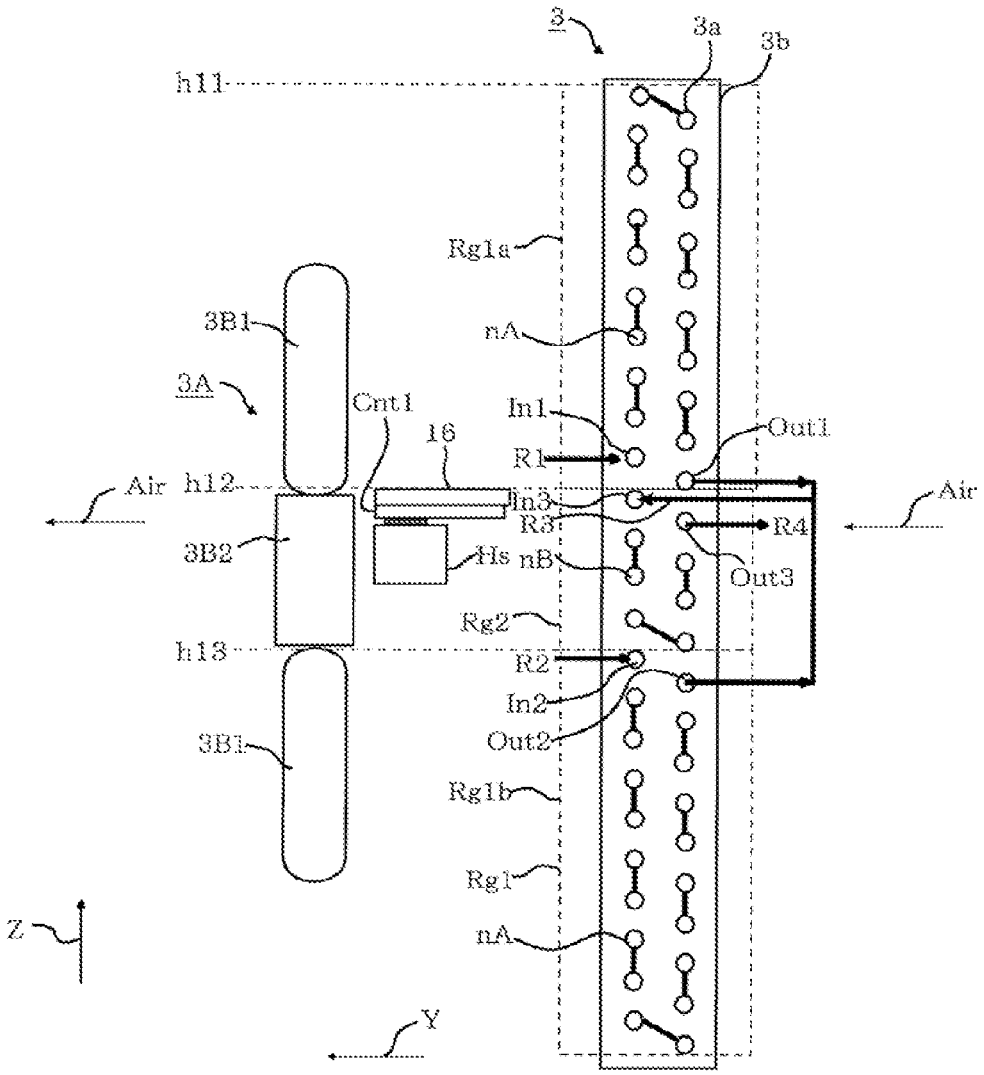
FIG. 10 is a diagram illustrating Modification of the outdoor unit 101 according to Embodiment 1.

FIG. 10 is a diagram illustrating Modification of the outdoor unit 101 according to Embodiment 1. In Modification, the second region Rg2 is interposed between the area Rg1*a* and the area Rg1*b* of the first region Rg1. A level at which the upper end of the area Rg1*a* is located is represented by a height coordinate h11. A level at which the upper end of the second region Rg2 and the lower end of the area Rg1*a* are located is represented by a height coordinate h12. A level at which the lower end of the second region Rg2 and the upper end of the area Rg1*b* are located is represented by a height coordinate h13. The heat sink Hs is disposed below the height coordinate h12 and above the height coordinate h13. The control board Cnt1 is also disposed below the height coordinate h12 and above the height coordinate h13. The height coordinate h11, the height coordinate h12, and the height coordinate h13 can be determined relative to, for example, the bottom plate 14, as a reference. In Modification, the heat sink Hs is disposed at the same level as a level of the boss 3B2 of the electric motor 3C. The flow rate of the air Air flowing to the boss 3B2 is greater than the flow rate of the air Air flowing to distal ends of the blades 3B1. This arrangement results in an increase in flow rate of the air Air to be supplied to the heat sink Hs in Modification, thus increasing the efficiency of heat dissipation of the heat sink Hs.

Advantageous effects of Embodiment 1 will be described below. The outdoor unit 101 includes no component like the cooling pipe described in Patent Literature 1. Such a configuration reduces or eliminates a reduction in amount of evaporation of the refrigerant in the outdoor heat exchanger 3 of the outdoor unit 101. This configuration reduces or eliminates a reduction in cooling capacity of the outdoor unit 101.

In Embodiment 1, the second distance between the heat sink Hs and the second region Rg2 is shorter than the first distance between the heat sink Hs and the first region Rg1. This arrangement causes the flow rate of air supplied to the heat sink Hs through the second region Rg2 to be greater than the flow rate of air supplied to the heat sink Hs through the first region Rg1.

In the cooling operation of the refrigeration cycle apparatus 100, the outdoor heat exchanger 3 is used as a condenser. The air passing through the outdoor heat exchanger 3 receives the latent heat of condensation of the refrigerant flowing through the outdoor heat exchanger 3. Thus, the air increases in temperature by passing through the outdoor heat exchanger 3. The second region Rg2 is located to receive single-phase liquid refrigerant. The refrigerant decreases in temperature by flowing in the second region Rg2. This operation reduces or eliminates a rise in temperature of the air supplied to the outdoor heat exchanger 3 when the air passes through the second region Rg2. As the heat sink Hs is supplied with the air of which a rise in temperature is reduced or eliminated, the outdoor unit 101 facilitates heat dissipation of the heat sink Hs. The outdoor unit 101 according to Embodiment 1 therefore facilitates the heat dissipation of the heat sink Hs while reducing or eliminating a reduction in cooling capacity.

Embodiment 2

Figure 11:
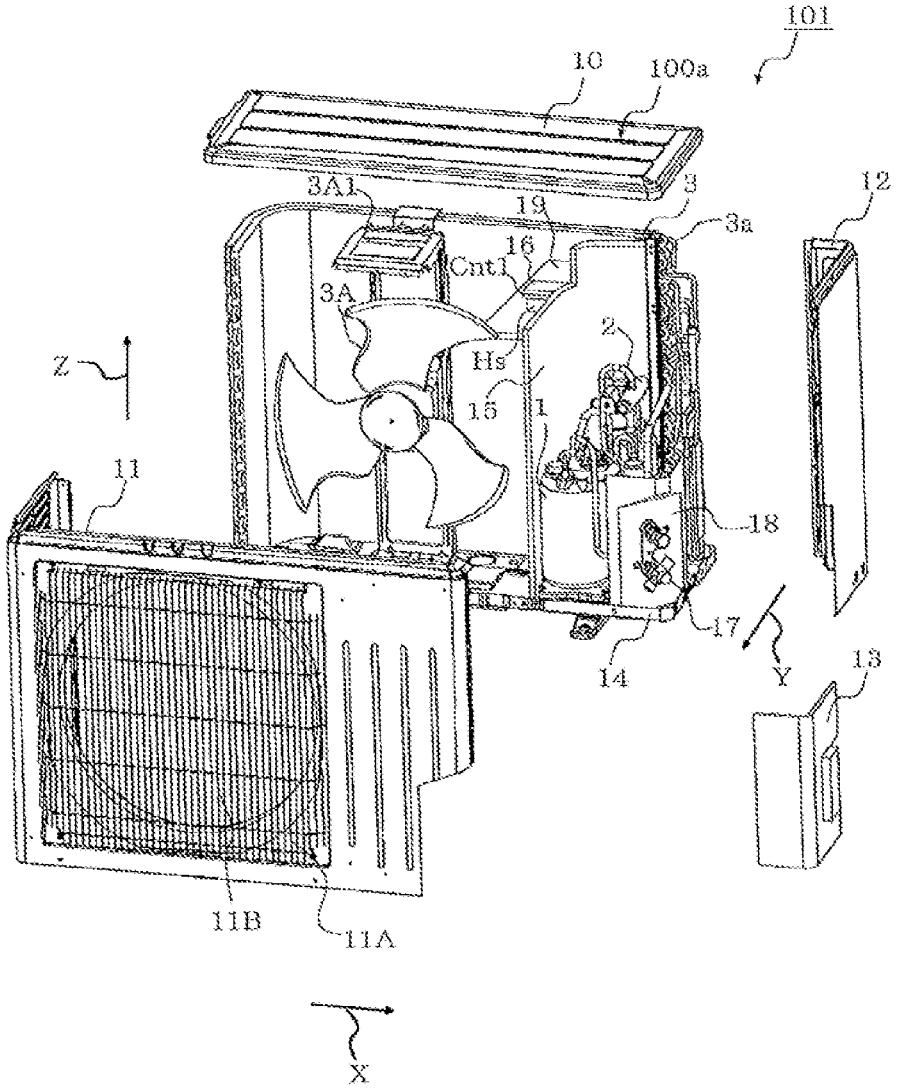
FIG. 11 is an exploded perspective view of an outdoor unit 101 according to Embodiment 2.
Figure 12:
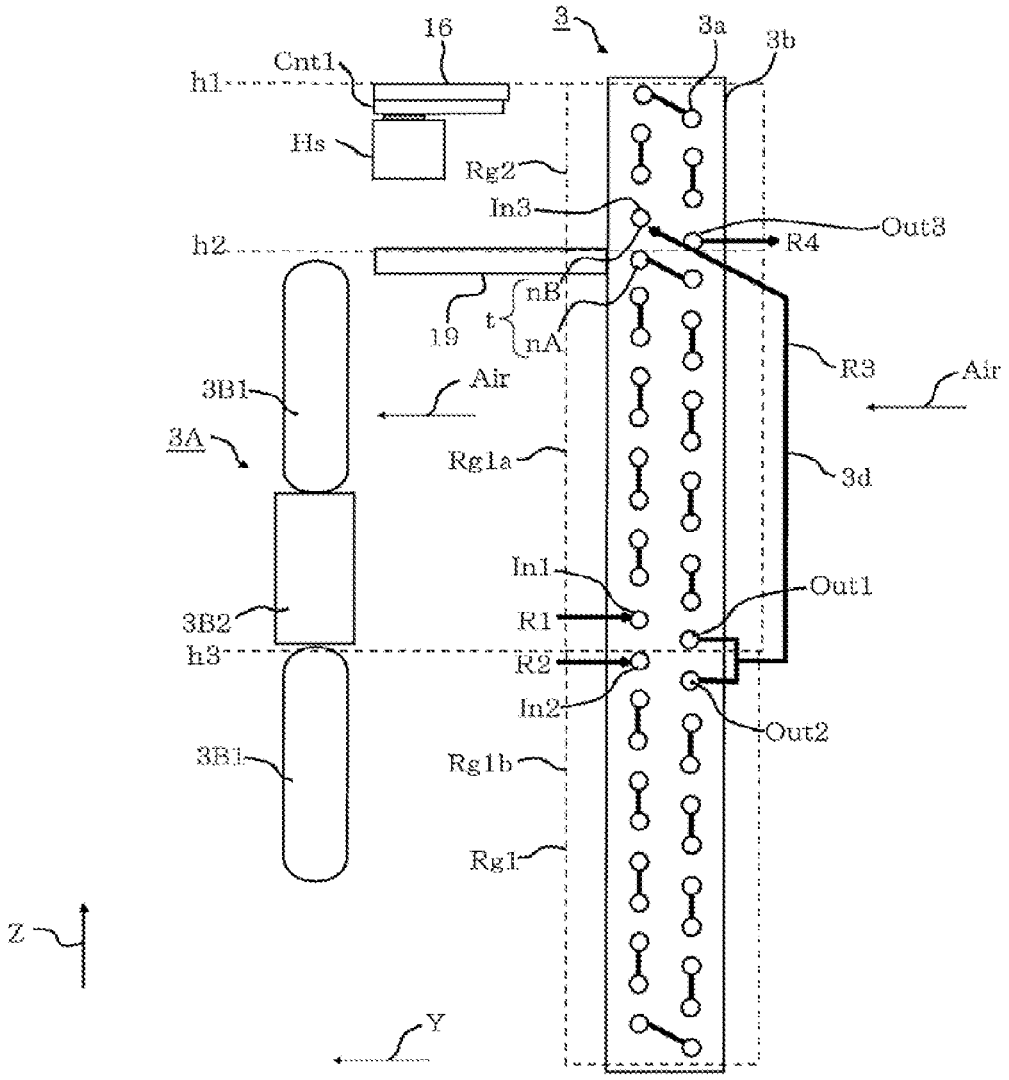
FIG. 12 is a diagram illustrating an arrangement of various components included in the outdoor unit 101 according to Embodiment 2.

FIG. 11 is an exploded perspective view of an outdoor unit 101 according to Embodiment 2. FIG. 12 is a diagram illustrating an arrangement of various components included in the outdoor unit 101 according to Embodiment 2. In Embodiment 2, the same components as those in Embodiment 1 are designated by the same reference signs. The following description will focus on the difference between Embodiment 2 and Embodiment 1. In Embodiment 2, a shield 19 is added to the components in Embodiment 1.

The flow direction of the air Air passing through the outdoor heat exchanger 3 is not limited to a direction parallel to the Y direction. In other words, the air Air flowing through the first region Rg1 may rise and be supplied to the heat sink Hs. As described in Embodiment 1, the temperature of the air Air leaving the second region Rg2 is lower than the temperature of the air Air leaving the first region Rg1. When the air Air flowing through the first region Rg1 rises and is supplied to the heat sink Hs, heat dissipation of the heat sink Hs is made difficult to be promoted.

The outdoor unit 101 according to Embodiment 2 includes the shield 19 that is plate-shaped and is disposed under the heat sink Hs. The shield 19 is disposed parallel to an X-Y plane. The shield 19 is secured to the partition 15. The shield 19 is located at the same level as the height coordinate h2 at which the lower end of the second region Rg2 is located.

Advantageous effects of Embodiment 2 will be described below. As the outdoor unit 101 according to Embodiment 2 includes the shield 19, such a configuration reduces or eliminates supply of the air Air through the first region Rg1 to the heat sink Hs. Thus, the outdoor unit 101 according to Embodiment 2 more reliably facilitates heat dissipation of the heat sink Hs.

Embodiment 3

Figure 13:
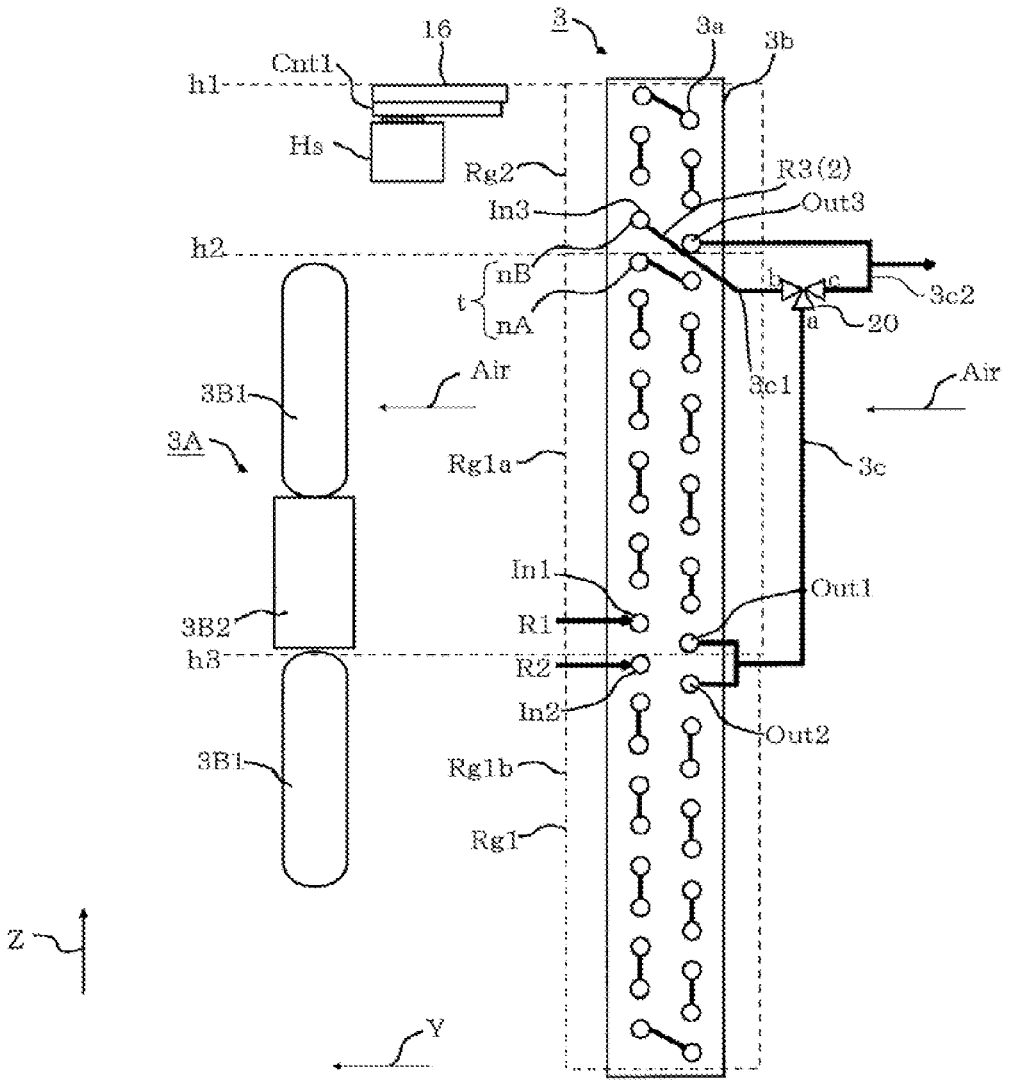
FIG. 13 is a diagram illustrating an arrangement of various components included in an outdoor unit according to Embodiment 3.

FIG. 13 is a diagram illustrating an arrangement of various components included in an outdoor unit according to Embodiment 3. In Embodiment 3, the same components as those in Embodiments 1 and 2 are designated by the same reference signs. The following description will focus on the difference between Embodiment 3 and Embodiments 1 and 2. In Embodiment 3, a flow switching device 20 is added to the components in Embodiment 1. Specifically, the outdoor unit according to Embodiment 3 includes the flow switching device 20 connected to the expansion device 4 for reducing the pressure of the refrigerant and the heat transfer tube 3*a*.

The flow switching device 20 includes an inflow port a, a first outflow port b, and a second outflow port c. The inflow port a is connected to the most downstream portion of the heat transfer tube 3*a* in the first region Rg1. More specifically, the inflow port a is connected to the pipe 3*c*. The first outflow port b is connected to the most upstream portion of the heat transfer tube 3*a* in the second region Rg2. More specifically, the first outflow port b is connected to the inlet IN3 of the second region Rg2 by a pipe 3*c*1. The second outflow port c is connected to the expansion device 4. More specifically, the second outflow port c is connected to a pipe 3*c*2. The pipe 3*c*2 is connected to the outlet Out3. Furthermore, the pipe 3*c*2 is connected to the expansion device 4.

Figure 14:
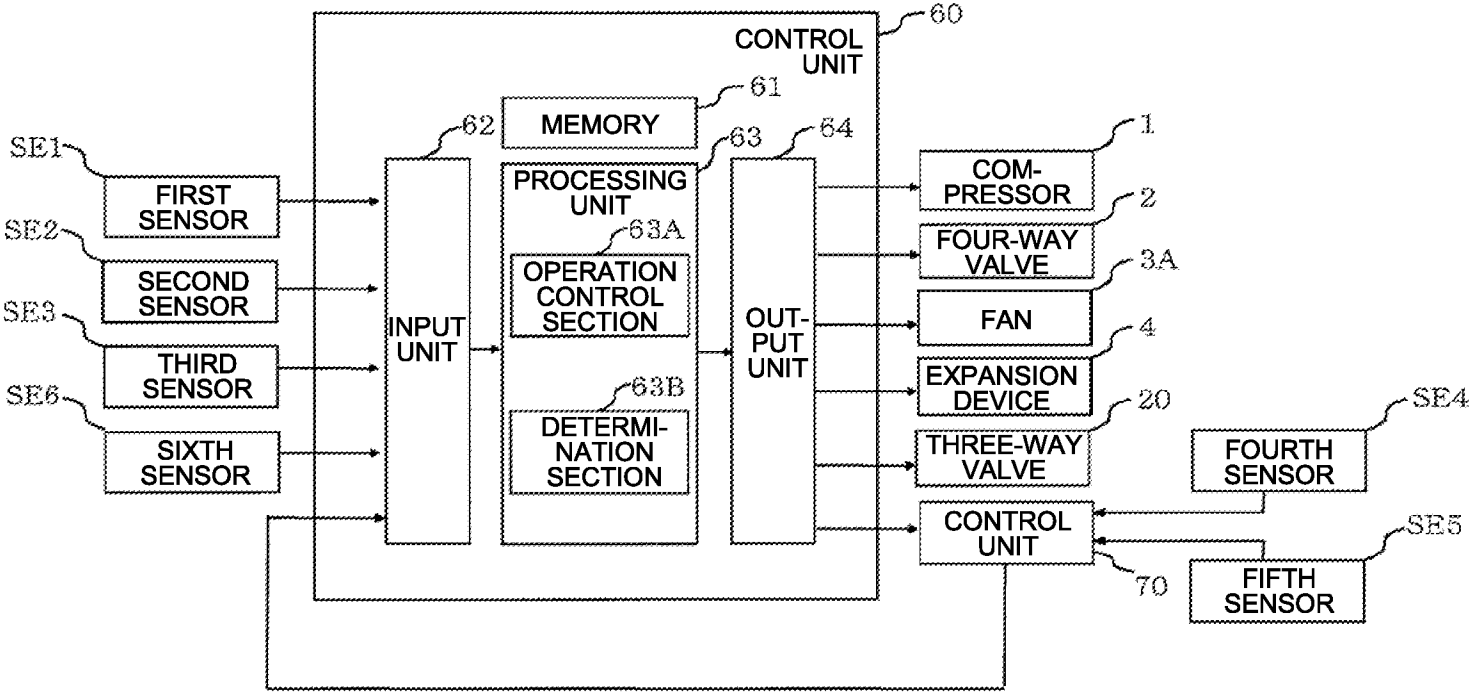
FIG. 14 is a functional block diagram of a control unit 60 included in the outdoor unit according to Embodiment 3.

FIG. 14 is a functional block diagram of a control unit 60 included in the outdoor unit according to Embodiment 3. The control unit 60 of the control board Cnt1 adjusts the flow switching device 20 on the basis of the temperature of the heat sink Hs. Specifically, the control unit 60 acquires a sensor signal concerning the temperature of the heat sink Hs from the first sensor SE1 (refer to FIGS. 1, 4, and 5). The control unit 60 adjusts the flow switching device 20 on the basis of the acquired sensor signal. The first sensor SE1 corresponds to a temperature sensor in the present invention. The processing unit 63 of the control unit 60 includes a determination section 63B. The determination section 63B is configured to compare the temperature of the heat sink Hs acquired from the first sensor SE1 with a predetermined reference temperature. In Embodiment 3, the predetermined reference temperature includes a first reference temperature T1 and a second reference temperature T2 that is lower than the first reference temperature T1. The predetermined reference temperatures are stored in the memory 61. The first reference temperature T1 is a temperature set to avoid breakage of, for example, the inverter E. The second reference temperature T2 is a reference temperature set to increase the life of, for example, the semiconductor device, rather than to avoid breakage of, for example, the inverter E.

Figure 15:
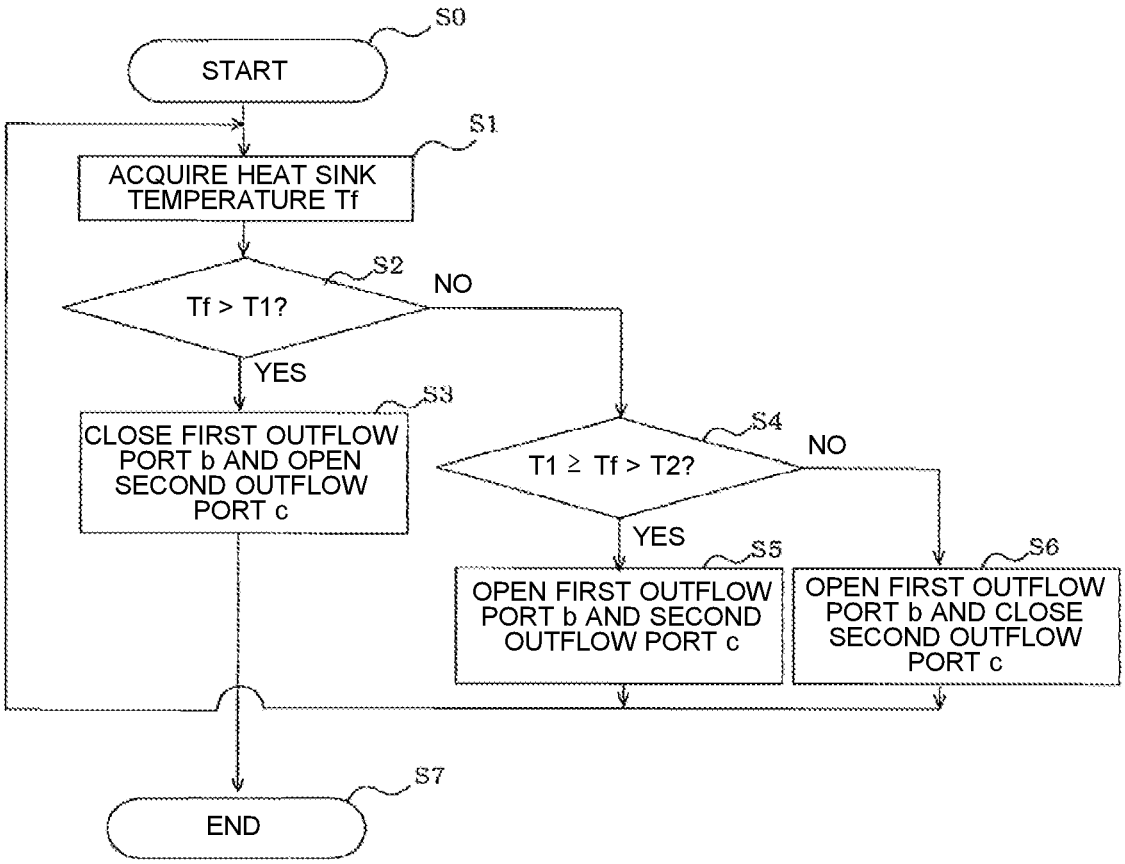
FIG. 15 is a flowchart of a control process for the outdoor unit according to Embodiment 3.

FIG. 15 is a flowchart of a control process for the outdoor unit according to Embodiment 3. In the following description on FIG. 15, the temperature of the heat sink Hs acquired from the first sensor SE1 will be abbreviated to a temperature Tf of the heat sink Hs. The control unit 60 of the control board Cnt1 acquires the temperature Tf of the heat sink Hs (step S1).

The control unit 60 of the control board Cnt1 determines whether the temperature Tf of the heat sink Hs is higher than the first reference temperature T1 (step S2). When the temperature Tf of the heat sink Hs is higher than the first reference temperature T1, the control unit 60 of the control board Cnt1 closes the first outflow port b and opens the second outflow port c (step S3). When the control process proceeds to step S3, it means avoiding breakage of, for example, the semiconductor device of the control board Cnt1. As the first outflow port b is closed, the refrigerant does not flow in the second region Rg2. Thus, the second region Rg2 is not used as a condenser. This operation reduces or eliminates a rise in temperature of the air passing through the second region Rg2. In other words, the heat sink Hs is supplied with the air having substantially the same temperature as the outdoor air temperature. This operation increases the efficiency of heat dissipation of the heat sink Hs.

The control unit 60 of the control board Cnt1 determines whether the temperature Tf of the heat sink Hs is at or below the first reference temperature T1 and is above the second reference temperature T2 (step S4). When the temperature of the heat sink Hs is at or below the first reference temperature T1 and is above the second reference temperature T2, the control unit 60 of the control board Cnt1 opens the first outflow port b and the second outflow port c (step S5). When the control process proceeds to step S5, it means that although, for example, the semiconductor device of the control board Cnt1 is less likely to break, it is preferable to increase the efficiency of heat dissipation of the heat sink Hs. As the first outflow port b and the second outflow port c are opened, part of the refrigerant flows to the second region Rg2 and the other refrigerant flows to the expansion device 4 in the cooling operation of the refrigeration cycle apparatus 100. As part of the refrigerant flows in the second region Rg2, the second region Rg2 is used as a condenser. This operation provides some degree of subcooling for the refrigerant. Furthermore, not the entire refrigerant flows in the second region Rg2. This operation reduces or eliminates a rise in temperature of the air passing through the second region Rg2. In other words, the heat sink Hs is supplied with the air of which a rise in temperature is reduced or eliminated. This operation increases the efficiency of heat dissipation of the heat sink Hs in step S5, though the efficiency in step S5 is lower than the efficiency in step S3.

When the temperature of the heat sink Hs is at or below the second reference temperature T2, the control unit 60 of the control board Cnt1 opens the first outflow port b and closes the second outflow port c (step S6). When the control process proceeds to step S6, it means that, for example, the semiconductor device of the control board Cnt1 is much less likely to break than the case in step S5. As the first outflow port b is opened and the second outflow port c is closed, the entire refrigerant leaving the first region Rg1 enters the second region Rg2. This operation more reliably provides some degree of subcooling for the refrigerant.

Advantageous effects of Embodiment 3 will be described below. The control unit 60 adjusts the flow switching device 20 on the basis of the temperature Tf of the heat sink Hs. Specifically, the control unit 60 adjusts the flow switching device 20 as described in steps S3 and S5, thereby avoiding breakage of, for example, the semiconductor device of the control board Cnt1. In addition, the control unit 60 adjusts the flow switching device 20 as described above in steps S5 and S6, thereby increasing the efficiency of heat dissipation of the heat sink Hs. Additionally, the control unit 60 adjusts the flow switching device 20 as described above in step S6, thereby more reliably providing some degree of subcooling for the refrigerant.

Embodiment 4

Figure 16:
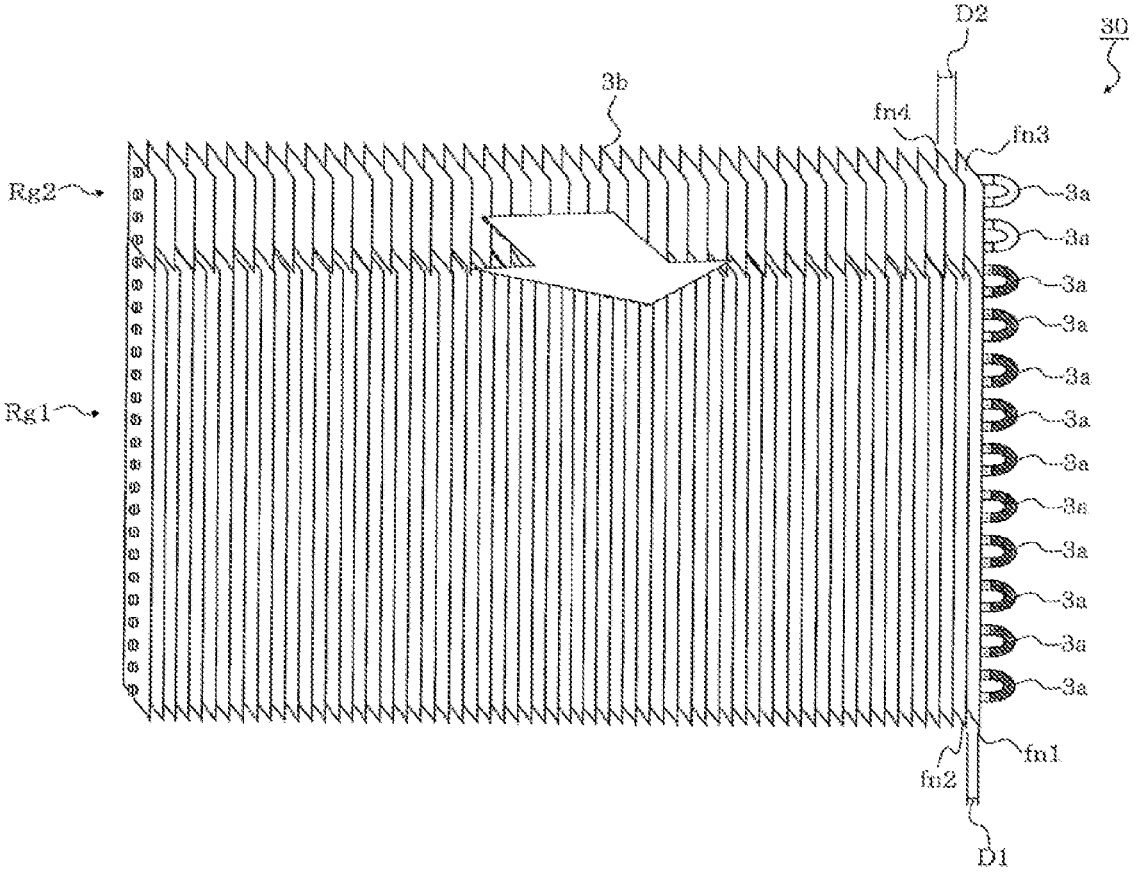
FIG. 16 is a schematic diagram of an outdoor heat exchanger of an outdoor unit according to Embodiment 4.

FIG. 16 is a schematic diagram of an outdoor heat exchanger 30 of an outdoor unit according to Embodiment 4. In Embodiment 4, the same components as those in Embodiments 1 to 3 are designated by the same reference signs. The following description will focus on the difference between Embodiment 4 and Embodiments 1 to 3. In Embodiment 4, an air flow resistance in the second region Rg2 is less than an air flow resistance in the first region Rg1. An air flow resistance correlates with a pressure loss. In other words, the greater the air flow resistance, the greater the pressure loss. The pressure loss can be expressed by the following mathematical formula.

$$\Delta P=\lambda\times Q^2 \quad \text{(Math.)}$$

In the mathematical formula, ΔP denotes the difference between a pressure on an upstream side of the outdoor heat exchanger 30 and a pressure on a downstream side of the outdoor heat exchanger 30. In other words, ΔP denotes a pressure loss in the air passing through the outdoor heat exchanger 30. In the mathematical formula, λ denotes a coefficient determined on the basis of, for example, the density of the air, the cross-sectional area of the outdoor heat exchanger 30 that is orthogonal to the air flow direction, and a resistance coefficient, and Q denotes the flow rate of the air passing through the outdoor heat exchanger 30.

The fins 3*b* of the outdoor heat exchanger 30 include a first fin fn1 to which the heat transfer tube 3*a* in the first region Rg1 is fixed and a first fin fn2 to which the heat transfer tube 3*a* in the first region Rg1 is fixed and that faces the first fin fn1 and is disposed at a distance corresponding to a fin pitch D1 from the first fin fn1. The first fin fn1 and the first fin fn2 are any adjacent fins to which the heat transfer tube 3*a* in the first region Rg1 is fixed. The fins 3*b* further include a second fin fn3 to which the heat transfer tube 3*a* in the second region Rg2 is fixed and a second fin fn4 to which the heat transfer tube 3*a* in the second region Rg2 is fixed and that faces the second fin fn3 and is disposed at a distance corresponding to a fin pitch D2 from the second fin fn3. The second fin fn3 and the second fin fn4 are any adjacent fins to which the heat transfer tube 3*a* in the second region Rg2 is fixed.

Advantageous effects of Embodiment 4 will be described below. In Embodiment 4, the fin pitch D2 is greater than the fin pitch D1. This arrangement causes the air flow resistance in the second region Rg2 to be less than the air flow resistance in the first region Rg1. Thus, the flow rate of the air passing per unit area of the second region Rg2 is greater than the flow rate of the air passing per unit area of the first region Rg1. This arrangement results in an increase in flow rate of the air to be supplied to the heat sink Hs, thus facilitating heat dissipation of the heat sink Hs.

Figure 17:
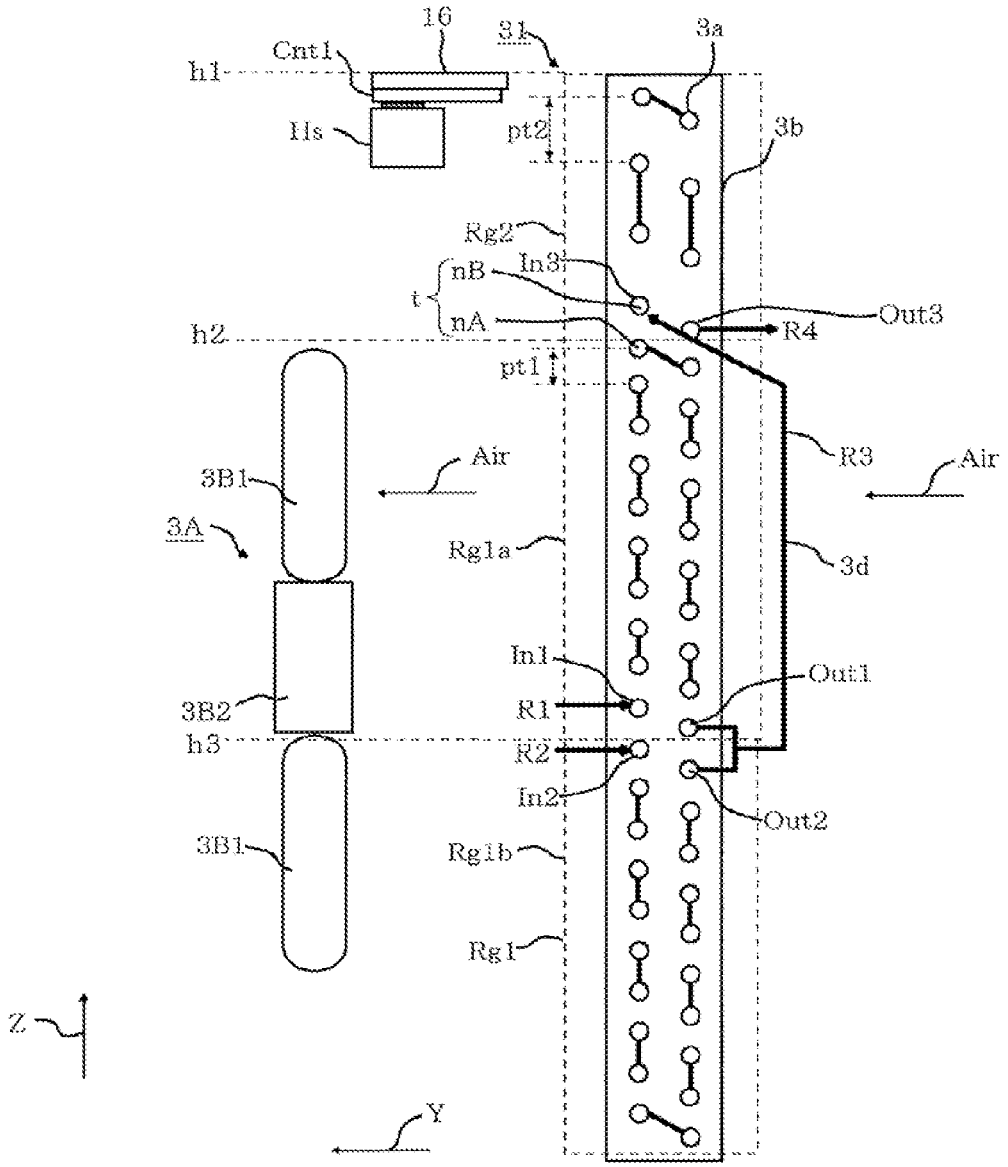
FIG. 17 is a diagram illustrating an outdoor heat exchanger of an outdoor unit according to Modification 1 of Embodiment 4.

FIG. 17 is a diagram illustrating an outdoor heat exchanger 31 of an outdoor unit according to Modification 1 of Embodiment 4. In the above-described arrangement in Embodiment 4, the fin pitch D2 is greater than the fin pitch D1. The arrangement is not limited to the above-described one. As illustrated in FIG. 17, a pitch pt2 of the heat transfer tube 3*a* in the second region Rg2 in the Z direction may be greater than a pitch pt1 of the heat transfer tube 3*a* in the first region Rg1 in the Z direction. In Modification 1, an air flow resistance in the second region Rg2 is less than an air flow resistance in the first region Rg1 as in Embodiment 4.

Figure 18:
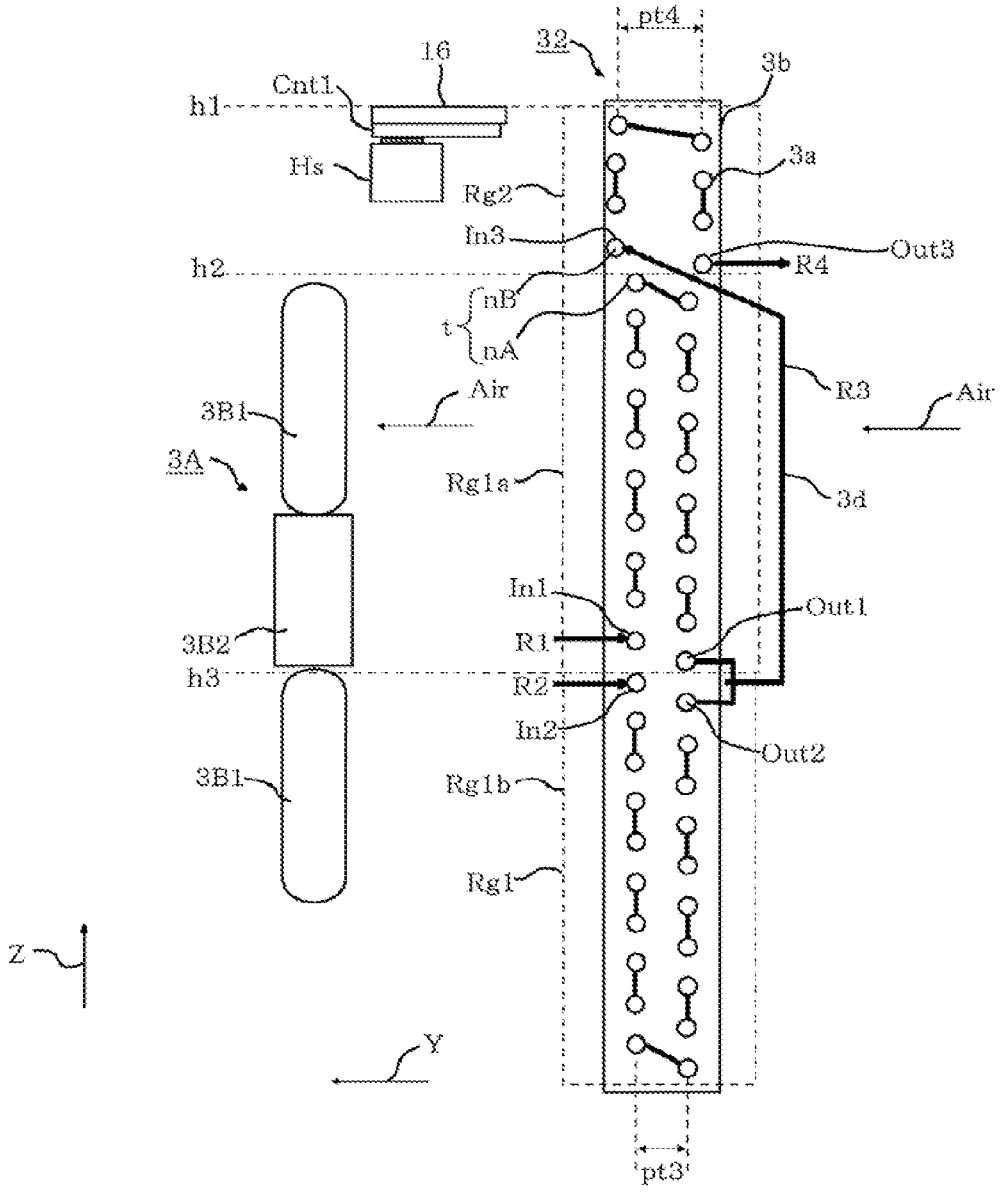
FIG. 18 is a diagram illustrating an outdoor heat exchanger of an outdoor unit according to Modification 2 of Embodiment 4.

FIG. 18 is a diagram illustrating an outdoor heat exchanger 32 of an outdoor unit according to Modification 2 of Embodiment 4. As illustrated in FIG. 18, a pitch pt4 of the heat transfer tube 3*a* in the second region Rg2 in the Y direction may be greater than a pitch pt3 of the heat transfer tube 3*a* in the first region Rg1 in the Y direction. In Modification 2, an air flow resistance in the second region Rg2 is less than an air flow resistance in the first region Rg1 as in Embodiment 4.

Figure 19:
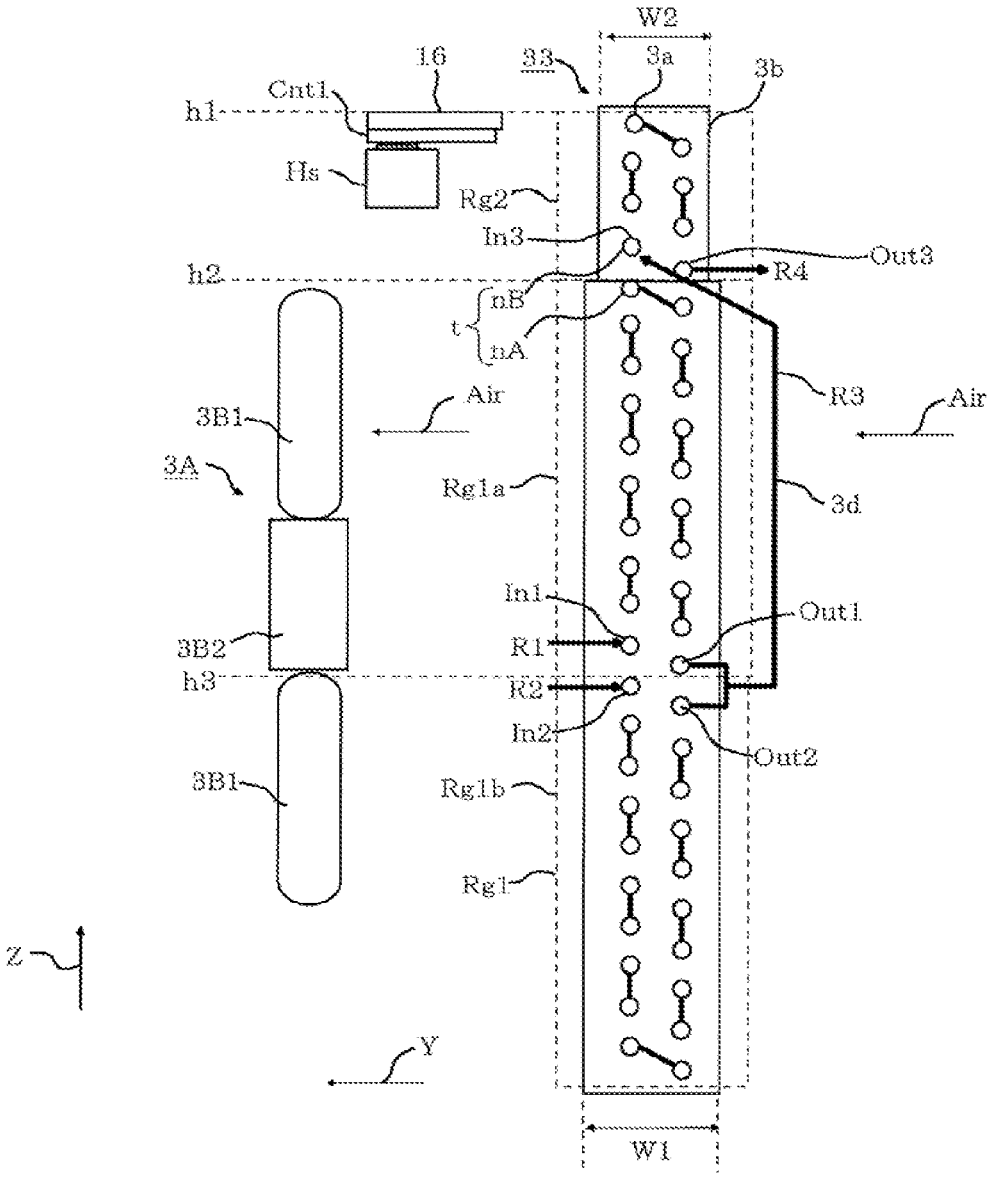
FIG. 19 is a diagram illustrating an outdoor heat exchanger of an outdoor unit according to Modification 3 of Embodiment 4.

FIG. 19 is a diagram illustrating an outdoor heat exchanger 33 of an outdoor unit according to Modification 3 of Embodiment 4. As illustrated in FIG. 19, a width W2 of the fins 3*b* in the second region Rg2 in the Y direction may be less than a width W1 of the fins 3*b* in the first region Rg1 in the Y direction. In Modification 3, an air flow resistance in the second region Rg2 is less than an air flow resistance in the first region Rg1 as in Embodiment 4.

Figure 20:
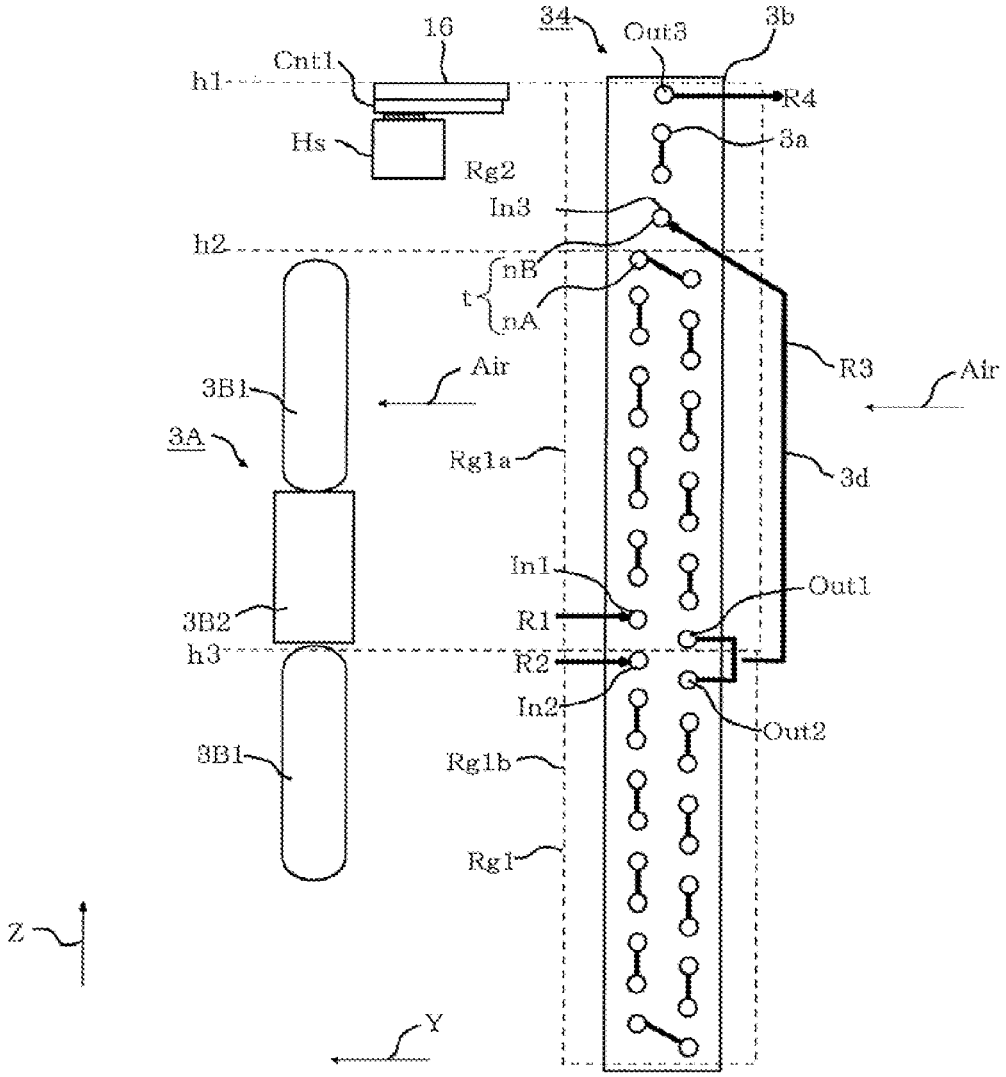
FIG. 20 is a diagram illustrating an outdoor heat exchanger of an outdoor unit according to Modification 4 of Embodiment 4.

FIG. 20 is a diagram illustrating an outdoor heat exchanger 34 of an outdoor unit according to Modification 4 of Embodiment 4. As illustrated in FIG. 20, the number of columns of the heat transfer tube 3*a* in the second region Rg2 in the Y direction may be less than the number of columns of the heat transfer tube 3*a* in the first region Rg1 in the Y direction. In Modification 4, an air flow resistance in the second region Rg2 is less than an air flow resistance in the first region Rg1 as in Embodiment 4. FIG. 20 illustrates an exemplary arrangement in which the number of columns of the heat transfer tube 3*a* in the second region Rg2 in the Y direction is one and the number of columns of the heat transfer tube 3*a* in the first region Rg1 in the Y direction is two.

Figure 21:
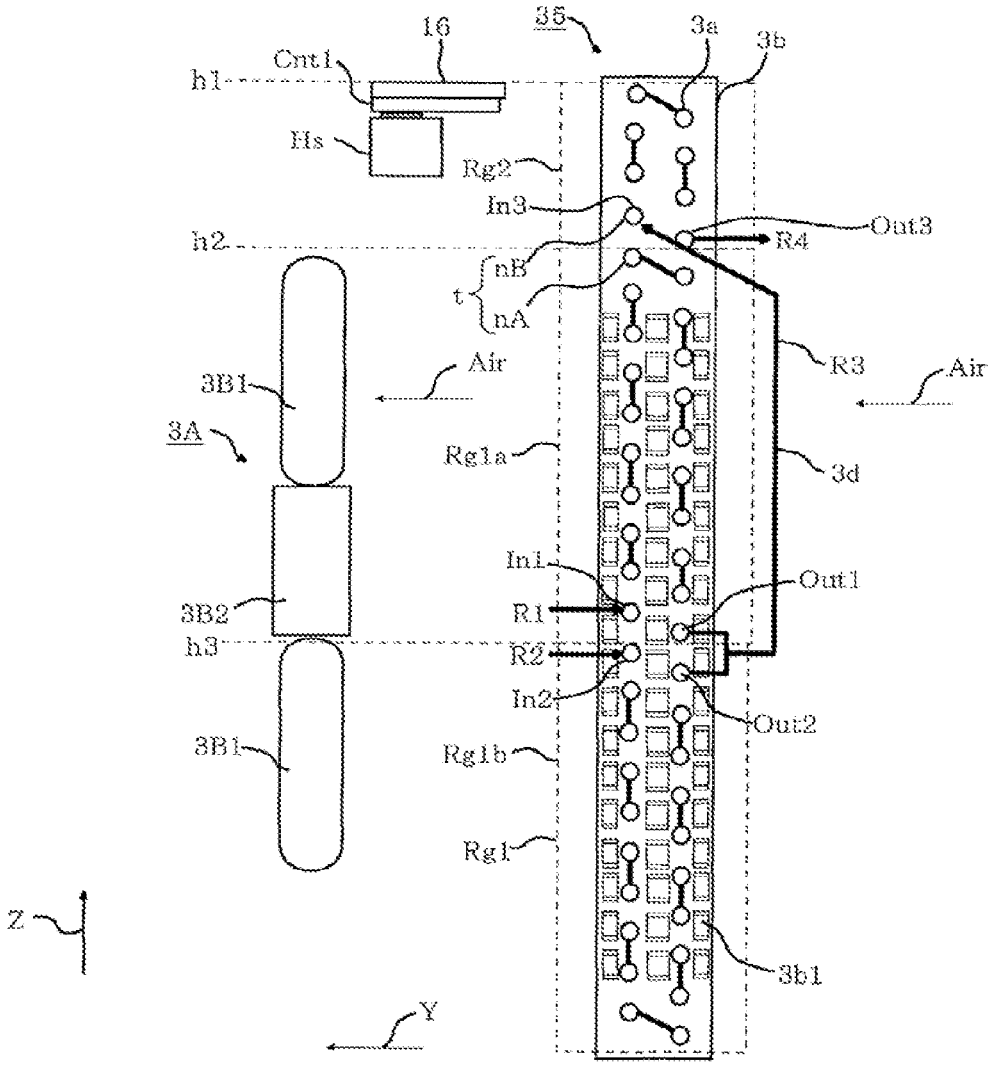
FIG. 21 is a diagram illustrating an outdoor heat exchanger of an outdoor unit according to Modification 5 of Embodiment 4.

FIG. 21 is a diagram illustrating an outdoor heat exchanger 35 of an outdoor unit according to Modification 5 of Embodiment 4. As illustrated in FIG. 21, the fins 3*b* in the first region Rg1 have cut-raised portions 3*b*1 to promote heat exchange between the outdoor heat exchanger 35 and the air Air. The fins 3*b* in the second region Rg2 have no cut-raised portions 3*b*1. In other words, the fins 3*b* in the second region Rg2 each have a flat surface. In Modification 5, an air flow resistance in the second region Rg2 is less than an air flow resistance in the first region Rg1 as in Embodiment 4.

In each of Modifications 1 to 5, the air flow resistance in the second region Rg2 is less than the air flow resistance in the first region Rg1 as in Embodiment 4. Thus, the flow rate of the air Air passing per unit area of the second region Rg2 is greater than the flow rate of the air Air passing per unit area of the first region Rg1. This arrangement results in an increase in flow rate of the air Air to be supplied to the heat sink Hs, thus facilitating heat dissipation of the heat sink Hs.

Embodiment 1, Modification of Embodiment 1, Embodiment 2, Embodiment 3, Embodiment 4, and Modifications 1 to 5 of Embodiment 4 can be appropriately combined.

The invention claimed is:

1. An outdoor unit, comprising:

a casing including an air passage;

an outdoor fan disposed in the air passage;

a compressor disposed in the casing;

an outdoor heat exchanger disposed in the casing, the outdoor heat exchanger including fins and a heat transfer tube connected to the fins;

a control board disposed in the casing, the control board including a control unit configured to control the compressor; and a heat sink disposed in the air passage in the casing, the heat sink being in contact with the control board, the heat transfer tube of the outdoor heat exchanger including a first region in which gas refrigerant or two-phase gas-liquid refrigerant flows when the outdoor heat exchanger is used as a condenser and a second region that is located downstream of the first region in a refrigerant flow direction and in which single-phase liquid refrigerant flows when the outdoor heat exchanger is used as a condenser, the heat sink being disposed downstream of the outdoor heat exchanger in an air flow direction in the air passage, the heat sink being located at a first distance from the first region and being located at a second distance from the second region, the second distance being shorter than the first distance, and the heat sink being located at a level identical with a level of a boss of the outdoor fan.

2. The outdoor unit of claim 1, wherein the heat transfer tube in the first region includes first horizontal parts extending parallel to a horizontal plane, wherein the heat transfer tube in the second region includes second horizontal parts extending parallel to the horizontal plane, and wherein the second horizontal parts are fewer in number than are the first horizontal parts.

3. The outdoor unit of claim 1, wherein the heat sink is disposed above a lower end of the second region and below an upper end of the second region.

4. The outdoor unit of claim 1, wherein the second region is located in an uppermost part of the outdoor heat exchanger.

5. The outdoor unit of claim 1, wherein an air flow resistance in the second region is less than an air flow resistance in the first region.

6. The outdoor unit of claim 1, wherein the fins include first fins to which the heat transfer tube in the first region is fixed and second fins to which the heat transfer tube in the second region is fixed, and wherein the second fins are arranged at a pitch greater than a pitch of the first fins.

7. The outdoor unit of claim 1, further comprising a shield that is plate-shaped and disposed under the heat sink.

8. An outdoor unit comprising:

a casing including an air passage;

an outdoor fan disposed in the air passage;

a compressor disposed in the casing;

an outdoor heat exchanger disposed in the casing, the outdoor heat exchanger including fins and a heat transfer tube connected to the fins;

a control board disposed in the casing, the control board including a control unit configured to control the compressor; and a heat sink disposed in the air passage in the casing, the heat sink being in contact with the control board, the heat transfer tube of the outdoor heat exchanger including a first region in which gas refrigerant or two-phase gas-liquid refrigerant flows when the outdoor heat exchanger is used as a condenser and a second region that is located downstream of the first region in a refrigerant flow direction and in which single-phase liquid refrigerant flows when the outdoor heat exchanger is used as a condenser, the heat sink being disposed downstream of the outdoor heat exchanger in an air flow direction in the air passage, the heat sink being located at a first distance from the first region and being located at a second distance from the second region, the second distance being shorter than the first distance, the outdoor unit further comprising a shield that is plate-shaped and disposed under the heat sink, and the shield being disposed at a level identical with a level of a lower end of the second region.

9. An outdoor unit comprising:

a casing including an air passage;

an outdoor fan disposed in the air passage;

a compressor disposed in the casing;

an outdoor heat exchanger disposed in the casing, the outdoor heat exchanger including fins and a heat transfer tube connected to the fins;

a control board disposed in the casing, the control board including a control unit configured to control the compressor; and a heat sink disposed in the air passage in the casing, the heat sink being in contact with the control board, the heat transfer tube of the outdoor heat exchanger including a first region in which gas refrigerant or two-phase gas-liquid refrigerant flows when the outdoor heat exchanger is used as a condenser and a second region that is located downstream of the first region in a refrigerant flow direction and in which single-phase liquid refrigerant flows when the outdoor heat exchanger is used as a condenser, the heat sink being disposed downstream of the outdoor heat exchanger in an air flow direction in the air passage, the heat sink being located at a first distance from the first region and being located at a second distance from the second region, the second distance being shorter than the first distance, the outdoor unit further comprising:

a temperature sensor disposed at the heat sink, the temperature sensor being configured to measure a temperature of the heat sink; and three-way valve connected to the heat transfer tube and an expansion device configured to reduce a pressure of refrigerant, the three-way valve including an inflow port connected to a most downstream portion of the heat transfer tube in the first region, a first outflow port connected to a most upstream portion of the heat transfer tube in the second region, and a second outflow port connected to the expansion device, and the control unit of the control board being configured to adjust the three-way valve on a basis of the temperature of the heat sink.

10. The outdoor unit of claim 9, wherein, when the temperature of the heat sink is above a first reference temperature, the control unit of the control board is configured to close the first outflow port and open the second outflow port.

11. The outdoor unit of claim 10, wherein, when the temperature of the heat sink is at or below the first reference temperature and is above a second reference temperature that is lower than the first reference temperature, the control unit of the control board is configured to open the first outflow port and the second outflow port.

12. The outdoor unit of claim 11, wherein, when the temperature of the heat sink is at or below the second reference temperature, the control unit of the control board is configured to open the first outflow port and close the second outflow port.

13. The outdoor unit of claim 10, wherein, when the temperature of the heat sink is at or below a second reference temperature that is lower than the first reference temperature, the control unit of the control board is configured to open the first outflow port and close the second outflow port.

14. The outdoor unit of claim 1, further comprising:

a mounting plate disposed in the air passage and to which the control board is attached; and a partition separating the air passage from a compressor chamber and to which the mounting plate is fixed, wherein the compressor is disposed in the compression chamber.

15. The outdoor unit of claim 8, further comprising:

a mounting plate disposed in the air passage and to which the control board is attached; and a partition separating the air passage from a compressor chamber and to which the mounting plate is fixed, wherein the compressor is disposed in the compression chamber.

16. The outdoor unit of claim 9, further comprising:

a mounting plate disposed in the air passage and to which the control board is attached; and a partition separating the air passage from a compressor chamber and to which the mounting plate is fixed, wherein the compressor is disposed in the compression chamber.

* * * * *